US009194637B2

(12) United States Patent
Mather

(10) Patent No.: US 9,194,637 B2
(45) Date of Patent: Nov. 24, 2015

(54) UNIVERSAL MAGAZINE LATCH MECHANISM FOR FIREARM

(71) Applicant: Sturm, Ruger & Company, Inc., Southport, CT (US)

(72) Inventor: Jonathan Philip Mather, Grafton, NH (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 14/270,169

(22) Filed: May 5, 2014

(65) Prior Publication Data

US 2014/0325886 A1 Nov. 6, 2014

Related U.S. Application Data

(60) Provisional application No. 61/819,282, filed on May 3, 2013.

(51) Int. Cl.
*F41A 9/61* (2006.01)
*F41A 17/38* (2006.01)

(52) U.S. Cl.
CPC ..... *F41A 17/38* (2013.01)

(58) Field of Classification Search
CPC ..... F41A 17/38; F41A 9/68; F41A 9/59; F41A 9/82; F41A 9/84; F41A 11/02
USPC ..... 42/6
See application file for complete search history.

(56) References Cited

U.S. PATENT DOCUMENTS

| | | | | |
|---|---|---|---|---|
| D118,863 | S | | 9/1871 | Kraatz |
| 285,234 | A | | 9/1883 | Coulthard et al. |
| 1,343,444 | A | * | 6/1920 | Formby ..... 89/156 |
| 1,439,903 | A | * | 12/1922 | Lewis ..... 89/142 |
| 1,452,123 | A | * | 4/1923 | McCrudden ..... 89/129.01 |
| 2,305,033 | A | * | 12/1942 | Roemer ..... 42/18 |
| 4,087,930 | A | | 5/1978 | Grehl |
| 4,102,242 | A | | 7/1978 | Liedke |
| 4,174,654 | A | | 11/1979 | Liedke |
| 4,326,353 | A | | 4/1982 | Ludwig et al. |
| 4,586,281 | A | | 5/1986 | Chesnut |
| 4,601,123 | A | | 7/1986 | Swearengen et al. |
| 4,677,781 | A | | 7/1987 | Lee |
| 4,747,224 | A | | 5/1988 | Smith |
| 5,054,221 | A | | 10/1991 | Ozols |
| 5,149,899 | A | | 9/1992 | Dabrowski |

(Continued)

OTHER PUBLICATIONS

Corresponding Interntional Search Report for PCT/US14/36846 dated Jan. 16, 2015.

*Primary Examiner* — Samir Abdosh

(74) *Attorney, Agent, or Firm* — The Belles Group, P.C.

(57) ABSTRACT

A universal magazine latch mechanism operable to retain and release a magazine from a firearm. In one embodiment, the mechanism may include a frame defining a magazine well configured to insertably receive a magazine holding a plurality of cartridges, a rear catch lever pivotably mounted to a rear wall of magazine well about a first pivot axis, and a side catch lever pivotably mounted to the frame about a second pivot axis. The rear catch lever is operable to engage/disengage rear or front style latching magazines. The side catch lever is operable to engage/disengage side catch style magazines. The rear catch lever is an actuator for operating both the rear and side catch levers, thereby latching and releasing all three catch styles of magazines with a single user action.

25 Claims, 16 Drawing Sheets

(56) References Cited

U.S. PATENT DOCUMENTS

| | | | |
|---|---|---|---|
| 5,357,703 | A | 10/1994 | Chesnut et al. |
| 5,533,291 | A | 7/1996 | Boland |
| 5,584,136 | A | 12/1996 | Boland et al. |
| 6,141,895 | A | 11/2000 | Rost et al. |
| 6,606,811 | B1 | 8/2003 | Olson |
| 6,871,437 | B1 | 3/2005 | Bartozzi et al. |
| 7,069,683 | B1 | 7/2006 | Kapusta |
| 7,497,044 | B2 | 3/2009 | Cammenga et al. |
| 7,559,166 | B2 | 7/2009 | Bubits |
| 7,562,482 | B1 | 7/2009 | Johnson |
| 7,596,900 | B2 | 10/2009 | Robinson et al. |
| 7,823,315 | B2 | 11/2010 | Webber et al. |
| 7,908,780 | B2 | 3/2011 | Fitzpatrick et al. |
| 7,921,587 | B2 | 4/2011 | Mayberry |
| 7,958,661 | B2 | 6/2011 | Strayer |
| 7,958,662 | B2 | 6/2011 | Mossberg et al. |
| 7,975,420 | B2 | 7/2011 | Pestana |
| 8,104,209 | B1 | 1/2012 | Bentley et al. |
| 8,156,675 | B2 | 4/2012 | Heath |
| 8,220,193 | B1 | 7/2012 | Lynch |
| 8,250,799 | B2 | 8/2012 | Duperry et al. |
| 8,356,439 | B2 | 1/2013 | Dubois |
| 8,387,297 | B2 | 3/2013 | Debrun et al. |
| D679,772 | S | 4/2013 | Mossberg |
| 8,407,922 | B1 | 4/2013 | Taylor |
| 8,418,390 | B1 | 4/2013 | Wright |
| 2005/0229459 | A1 | 10/2005 | McGarry |
| 2010/0281736 | A1 | 11/2010 | Mayberry et al. |
| 2011/0232148 | A1 | 9/2011 | Cain et al. |
| 2011/0283580 | A1 | 11/2011 | Esch |
| 2012/0047786 | A1 | 3/2012 | Dextraze et al. |
| 2012/0073429 | A1 | 3/2012 | Bowles et al. |
| 2012/0198743 | A1 | 8/2012 | Bentley et al. |
| 2012/0255209 | A1 | 10/2012 | Klassen |
| 2012/0260791 | A1 | 10/2012 | Kerbrat et al. |
| 2012/0272555 | A1 | 11/2012 | Heath |
| 2013/0026923 | A1 | 1/2013 | Athalye et al. |
| 2013/0081315 | A1 | 4/2013 | Thordsen |
| 2013/0269231 | A1 | 10/2013 | Pietrzyk |

* cited by examiner

UNIVERSAL MAGAZINE LATCH MECHANISM FOR FIREARM

CROSS-REFERENCE TO RELATED APPLICATIONS

The present application claims the benefit of U.S. Provisional Patent Application Ser. No. 61/819,282 filed May 3, 2013, which is incorporated herein by reference in its entirety.

BACKGROUND OF THE INVENTION

The present invention generally relates to firearms, and more particularly to magazine latch mechanism suitable for bolt action firearms such as without limitation rifles.

Many different firearms have been produced to shoot popular cartridges like the 5.56 NATO, 7.62 NATO and similar cartridges, but not all of these firearms use the same type of magazines, and the magazines are usually not interchangeable. This has created a market where three or four types of magazines are readily available and together support the majority of popular firearms. In some cases, there are magazines used in auto-loading firearms and magazines used in bolt action rifles that are similar, but not interchangeable.

SUMMARY OF THE INVENTION

A universal magazine latch mechanism described herein allows firearms to accept magazines with different types of retention or catch features while conveniently providing actuation by a single release lever that operates the mechanism. In one embodiment, the magazine latch mechanism accepts and functions with front catch style magazines having a dual front retention feature (e.g. opening or window) and rear retention feature (e.g. protruding lip or ridge), rear catch style magazine having a rear retention feature alone (e.g. protruding lip or ridge), and side catch style magazines having a lateral or side retention feature (e.g. opening or window). This present mechanism can be especially beneficial on bolt action rifles where last-round bolt lock features are not necessary and bolt speeds are much slower. The use of a single release lever means that the firearm can be operated the same way no matter what magazine is in use, thereby providing an integrated latching system for retaining and releasing magazines from a firearm having numerous different style catches.

One embodiment of the present multi-function magazine latch mechanism advantageously operates all three of the foregoing catch style magazines from a single catch lever mounted at the rear of the magazine well between the trigger guard and magazine well.

According to one embodiment, a universal magazine latching mechanism for a firearm includes a frame defining a magazine well configured to releasably receive a magazine, and a rear catch lever pivotably mounted proximate to a rear wall of the magazine well about a first pivot axis. The rear catch lever is configured and positioned with respect to the magazine well to retain and release a first magazine inserted in the magazine well having a rear catch. The rear catch lever is movable between a latched position in which the rear catch lever engages the first magazine when inserted in the magazine well and an unlatched position in which the rear catch lever disengages the first magazine. A side catch lever is pivotably mounted to the frame about a second pivot axis. The side catch lever is configured and positioned with respect to the magazine well to retain and release a second magazine inserted in the magazine well having a side catch. The side catch lever is movable between a latched position in which the side catch lever engages the second magazine when inserted in the magazine well and an unlatched position in which the side catch lever disengages the second magazine. The rear catch lever and side catch lever are mutually configured and arranged so that pivoting the rear catch lever pivots both the rear catch lever and side catch lever between their respective latched and unlatched positions. In one embodiment, inserting the second magazine with side catch in the magazine well does not move or pivot the rear catch lever about its pivot axis.

According to another embodiment, a universal magazine latching mechanism for a firearm includes a frame defining a longitudinal axis and a magazine well configured to releasably receive a magazine, and an L-shaped side catch lever pivotably mounted to the frame about a first pivot axis. The side catch lever includes an operation arm and a latching arm. The side catch lever is configured and positioned with respect to the magazine well to retain and release a first magazine inserted in the magazine well. A vertically elongated rear catch lever is pivotably mounted proximate to a rear wall of the magazine well about a second pivot axis disposed below the side catch lever. The rear catch lever is configured and positioned with respect to the magazine well to retain and release a second magazine inserted in the magazine well. The side catch lever is movable between a latched position engaged with and retaining the first magazine when inserted in the magazine well, and an unlatched position disengaged from and releasing the first magazine from the magazine well. The rear catch lever is movable between a latched position engaged with and retaining the second magazine when inserted in the magazine well, and an unlatched position disengaged from and releasing the second magazine from the magazine well. When the rear catch lever is moved from the latched position to the unlatched position, the rear catch lever engages and moves the side catch lever from the latched position to the unlatched position. Inserting the first magazine with side catch in the magazine well does not move or pivot the rear catch lever.

A method for retaining and releasing magazines from a firearm is a provided. The method includes: inserting a first magazine into a magazine well, the first magazine having a side catch feature; engaging a side catch lever with the side catch feature of first magazine to retain the first magazine in the magazine well; manually pushing and pivoting a rear catch lever about a pivot axis; laterally displacing the side catch lever with the rear catch lever; and disengaging the side catch lever from the side catch feature of the first magazine to release the first magazine from the magazine well; wherein inserting the first magazine in the magazine well does not pivot the rear catch lever.

According to a second embodiment, a universal magazine latching mechanism for a firearm includes a frame defining a magazine well configured to releasably receive a magazine and a rear catch lever pivotably mounted proximate to a rear wall of the magazine well about a first pivot axis. The rear catch lever is configured and positioned with respect to the magazine well to retain and release a first magazine inserted in the magazine well having a rear catch. The rear catch lever being movable between a latched position in which the rear catch lever engages the first magazine when inserted in the magazine well and an unlatched position in which the rear catch lever disengages the first magazine. A side catch lever is slidably mounted to the frame. The side catch lever is configured and positioned with respect to the magazine well to retain and release a second magazine inserted in the magazine well having a side catch. The side catch lever being laterally movable with a linear motion between a latched position in which the side catch lever engages the second magazine when inserted in the magazine well and an unlatched position in which the side catch lever disengages the second magazine. The rear catch lever and side catch lever are mutually configured and arranged so that pivoting the rear catch lever linearly moves the side catch lever in a lateral direction between the latched and unlatched positions. In one embodiment, the side catch lever includes an inclined cam surface which is engaged by a cam protrusion on the rear catch lever for moving the side catch lever between the latched and unlatched positions. In one embodiment, the side catch lever is independently movable of the rear catch lever and includes an actuating button that operates to move the side catch lever from the latched position to the unlatched position when depressed by a user.

BRIEF DESCRIPTION OF THE DRAWINGS

The features of the preferred embodiments will be described with reference to the following drawings where like elements are labeled similarly, and in which.

Figure 1:
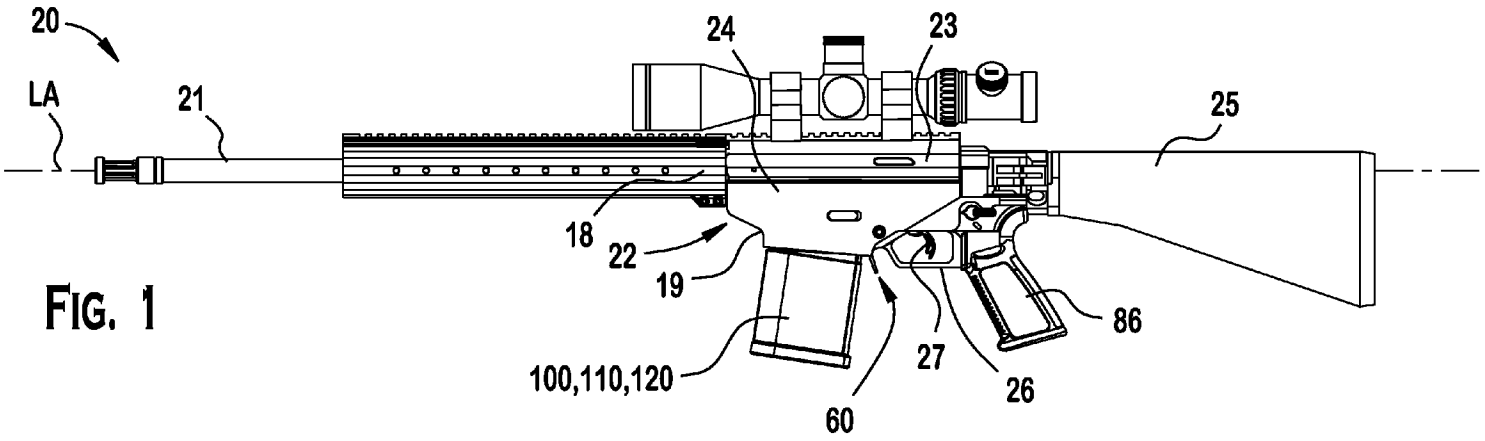
FIG. 1 is a right side view of a firearm in the exemplary form of a rifle including a magazine latch mechanism according to a first embodiment of the present invention.

All drawing shown herein are schematic and not to scale.

DETAILED DESCRIPTION

The features and benefits of the invention are illustrated and described herein by reference to preferred embodiments. This description of preferred embodiments is intended to be read in connection with the accompanying drawings, which are to be considered part of the entire written description. Accordingly, the invention expressly should not be limited to such preferred embodiments illustrating some possible non-limiting combination of features that may exist alone or in other combinations of features; the scope of the invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise.

Rifle magazines are typically retained in the firearm by one of several popular means. On magazines like the ones used in AR-15/M16s, SR25/AR10 and HK G3/91 style rifles, a catch located on the side of the magazine well engages a cut out or cavity in the side of the magazine. These magazines are typically released by pushing a button on the right hand side of the rifle which slides the catch out of the magazine.

Other magazines like the ones used in M14/M1A rifles and the Ruger Mini-14 have an opening in the front of the magazine that fits over a pin or post in the magazine well and a lip on the back that a spring loaded lever locks underneath to retain the magazine in the firearm. Moving the lever toward the magazines releases the lip so that the magazine can be removed. Some other magazines are similar to this, but have a lip on both the front and back.

Another type of magazine was popularized by Accuracy International® Ltd. and is used in many bolt action rifles. These magazines only have a lip on the back and are not retained in the front. They are released the same way but do not necessarily have the lip in the same position.

In addition to different retention methods, magazines often have slightly different width and depth dimensions even when designed for the same cartridge. In order for different sized magazines to fit properly in the same firearm, the magazine well of the firearm needs to be shaped to prevent the magazines from moving around too much when mounted. For some configurations, the magazine well may incorporate spring loaded contact points to stabilize magazines at the extreme ends of the size range and avoid excessive play in the magazine well.

The universal magazine latch mechanism described herein is configured to advantageously allow all three types of magazines described above to be used in the same firearm and operated with a single actuation lever. In one aspect, a single common release or actuator lever at the rear of the magazine well is advantageously used to selectively retain and release "front" catch style magazines having dual retention features including a rear retention protrusion (e.g. lip or ridge) and a front retention opening (e.g. M14/M1A rifles and the Ruger Mini-14) or "rear" catch style magazines having a rear retention feature (e.g. protruding lip or ridge) alone (e.g. Accuracy International magazines). With a magazine well having a sufficient height that supports a substantial amount of the magazine, the front retention feature on a front catch style magazine (e.g. window or opening) is not required to properly retain and support the magazine in the magazine well. Accordingly, the front pin or post in magazine wells that are typically provided for front catch style magazine need not be relied upon and provided according to a preferred embodiment of the present invention to properly retain such M14 style front catch magazines, just the rear catch by configuring the magazine well appropriately as describe herein.

Figure 3:
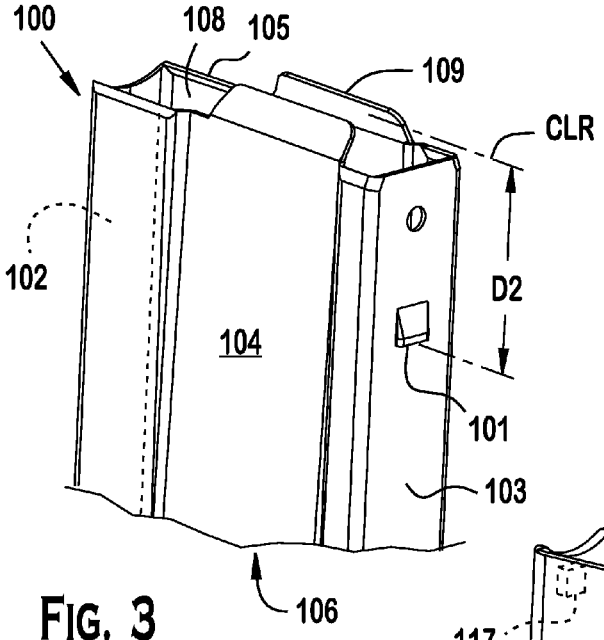
FIG. 3 is a left side perspective view of a rear catch style magazine having a rear retention feature and usable with the present magazine latch mechanism.

FIG. 3 shows an exemplary embodiment of a rear catch style magazine 100 having a rear retention feature only such as protruding lip 101. Magazine 100 may be box type magazine including an open upper end 105, closed lower end 106, front wall 102, rear wall 103, and opposing sidewalls 104. Magazine 100 defines an internal cavity 108 configured for holding multiple shells or cartridges in vertical stacked relationship. Magazine 100 has a generally rectangular cross-sectional shape. The magazine includes a follower and spring (not shown) which bias the cartridges upward towards the open upper end 105 for loading into the action of a firearm. The upper end 105 includes a pair of cartridge retaining lips 109 for preventing the spring biased stack of cartridges from being ejected prematurely from the magazine until stripped out of the magazine one by one by the action of the firearm. The magazine 100 may be made of suitable metal or plastic.

Figure 4:
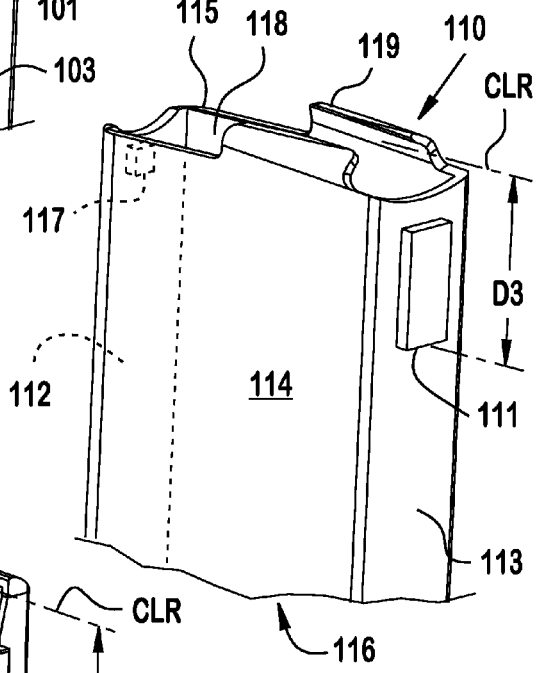
FIG. 4 is a left side perspective view of a front catch style magazine having dual rear and front retention features and usable with the present magazine latch mechanism.

FIG. 4 shows an exemplary embodiment of a front catch style magazine 110 having a dual rear retention feature such as protruding lip 111 and a front retention feature such as latch window 117. Magazine 110 may be box type magazine including an open upper end 115, closed lower end 116, front wall 112, rear wall 113, and opposing sidewalls 114. Magazine 110 defines an internal cavity 118 configured for holding multiple shells or cartridges in vertical stacked relationship. Magazine 110 has a generally rectangular cross-sectional shape. The magazine includes a follower and spring (not shown) which bias the cartridges upward towards the open upper end 115 for loading into the action of a firearm. The upper end 115 includes a pair of cartridge retaining lips 119 for preventing the spring biased stack of cartridges from being ejected prematurely from the magazine until stripped out of the magazine one by one by the action of the firearm. The magazine 110 may be made of suitable metal or plastic.

Figure 5:
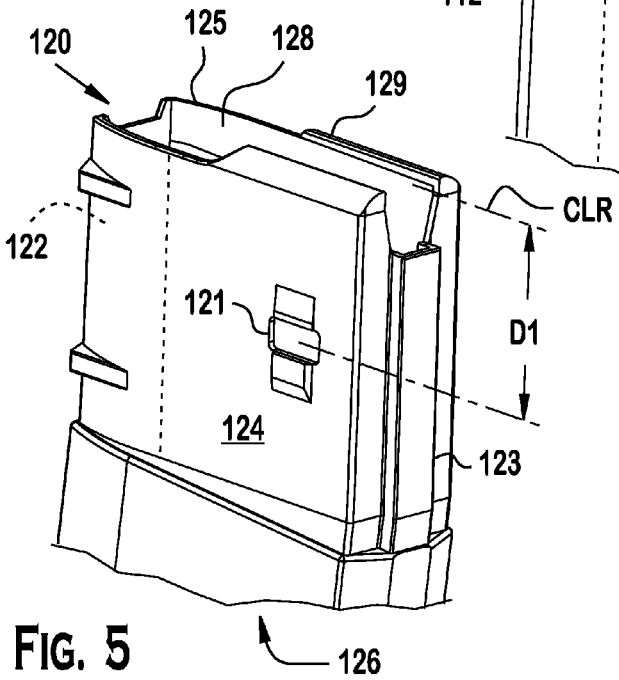
FIG. 5 is a left side perspective view of a side catch style magazine having side retention feature and usable with the present magazine latch mechanism.

FIG. 5 shows an exemplary embodiment of a side catch style magazine 120 having a side retention feature only such as latch opening 121. Magazine 120 may be box type magazine including an open upper end 125, closed lower end 126, front wall 122, rear wall 123, and opposing sidewalls 124. Magazine 120 defines an internal cavity 128 configured for holding multiple shells or cartridges in vertical stacked relationship. Magazine 120 has a generally rectangular cross-sectional shape. The magazine includes a follower and spring (not shown) which bias the cartridges upward towards the open upper end 125 for loading into the action of a firearm. The upper end 125 includes a pair of cartridge retaining lips 129 for preventing the spring biased stack of cartridges from being ejected prematurely from the magazine until stripped out of the magazine one by one by the action of the firearm. The magazine 120 may be made of suitable metal or plastic.

An exemplary embodiment of a magazine latch mechanism according to the present disclosure will now be described for convenience with reference to a long gun type firearm such as without limitation a rifle 20. The principles and features of the embodiments disclosed herein, however, may be used with equal benefit for other types of firearms including shotguns, pistols, or other type firearms. Accordingly, the invention is not limited in its applicability or scope to rifles alone as described herein.

FIGS. 1-28 show a first embodiment of a magazine latch mechanism 60 according to the principles of the present invention.

FIG. 1 depicts a left side view of a rifle 20 including a barrel 21 mounted to a receiver 22 comprised of an upper receiver 23, lower receiver 24, and a buttstock 25 attached to the receiver. Barrel 21 has a bore defining a bullet pathway and rear chamber 18 configured to hold a shell or cartridge C for firing. In one embodiment, barrel 21 is supported by the upper receiver 23 and may be mounted via a threaded connection or other type mechanical coupling.

In one configuration, lower receiver 24 forms a frame 19 that may include a pistol grip 86 at a rear end, a magazine well 30 at a front end, and a trigger guard 26 disposed therebetween. The frame formed by lower receiver 24 defines a longitudinal axis LA and corresponding axial direction for reference. The trigger guard 26 may comprise a generally strap-like structure having a flat or arcuate shape that may be connected between the pistol grip 86 and magazine well 30 in one design; however, other variations of trigger guards are possible. For example, in other configurations such as rifle 20 or an HK G3/91 rifle, the trigger guard 26 may extend forward from the grip 86 and curve or bend upwards behind the magazine well 30 to connect to the bottom of the lower receiver 24 behind the well in lieu of being directly connected to the magazine well. This forms a gap between the trigger guard 26 and magazine well 30 for placement of the operating portion of magazine latch mechanism 60 in one embodiment. The trigger guard surrounds and protects a trigger 27 from inadvertent actuation. Trigger 27 is pivotably mounted to the receiver 22 and operably coupled to the fire control system components disposed in the lower receiver that function to discharge the rifle via a trigger pull.

With additional reference now to FIGS. 2, 6-11, and 16, the magazine well 30 is an open four sided axially elongated and oblong frame in structure having a sufficient height to effectively retain the magazine in a stable manner. Magazine well 30 includes a front wall 34, rear wall 35, and opposing lateral sidewalls 36 extending between the front and rear walls. The walls 34, 35, 36 define an internal receptacle 31 with open bottom 32 for slideably inserting a magazine therein containing a spring-biased vertical stack of shells or cartridges. Such "box style" magazines as they are commonly referred to in the art and their operation are well known to skilled artisans without further elaboration. The top 33 of magazine well 30 is similarly open and communicates with receptacle 31 and the firing pathway of the action (i.e. bolt and firing pin path) in the upper receiver 23 for uploading cartridges into the action of the rifle 20 and barrel chamber. The magazine presents a fresh cartridge to the reciprocating bolt which strips the cartridge from the magazine and is loaded into the barrel chamber.

In one embodiment, the magazine well does not have a pin or post on the front wall 34 as commonly found in firearms design to use front catch style magazines. Instead, the magazine well has a sufficient height H1 at the front wall 34 of the magazine well 30 (see FIG. 6) to fully retain a front catch style magazine with a front mounting window 117 (FIG. 5) and a rear mounting lip in a stable manner without a pin/post. In one embodiment, the minimum preferred height H1 measured from the top 33 to the bottom 32 of magazine well 30 at the front wall 34 necessary to securely retain front catch style magazines without excessive play in the magazine well is at least 1.3 inches.

A magazine latch mechanism 60 is provided that can accommodate different rear, side, and front catch style magazines. In one embodiment, the magazine latch mechanism 60 includes a first rear catch lever 61 and a second side catch lever 62. The rear catch lever 61 is configured to retain an Accuracy International® type or other rifle magazines having a rear catch (i.e. rear or front catch mounted styles) in the magazine well 30. The side catch lever 62 retains SR25/AR-10, AR-15/M16, HK G3/91, or other side catch style rifle magazines in the magazine well 30.

Figure 2:
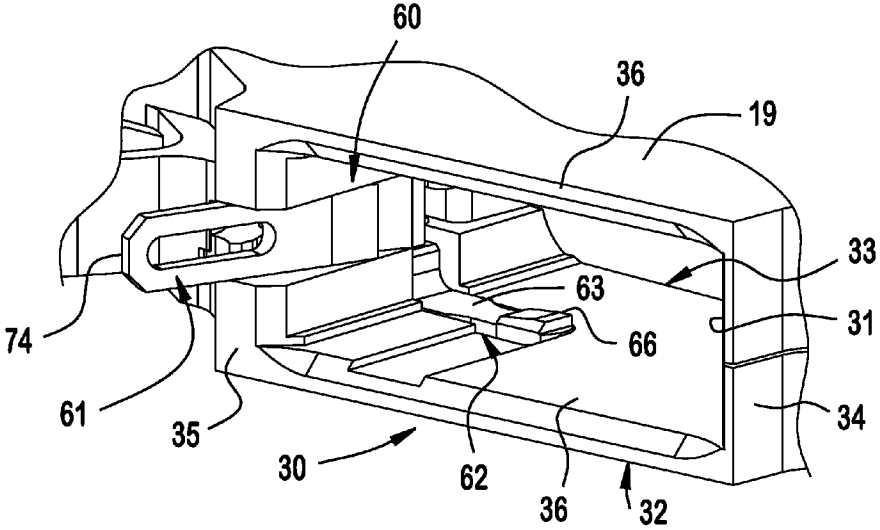
FIG. 2 is a bottom perspective view of the magazine well of the rifle in FIG. 1.
Figure 6:
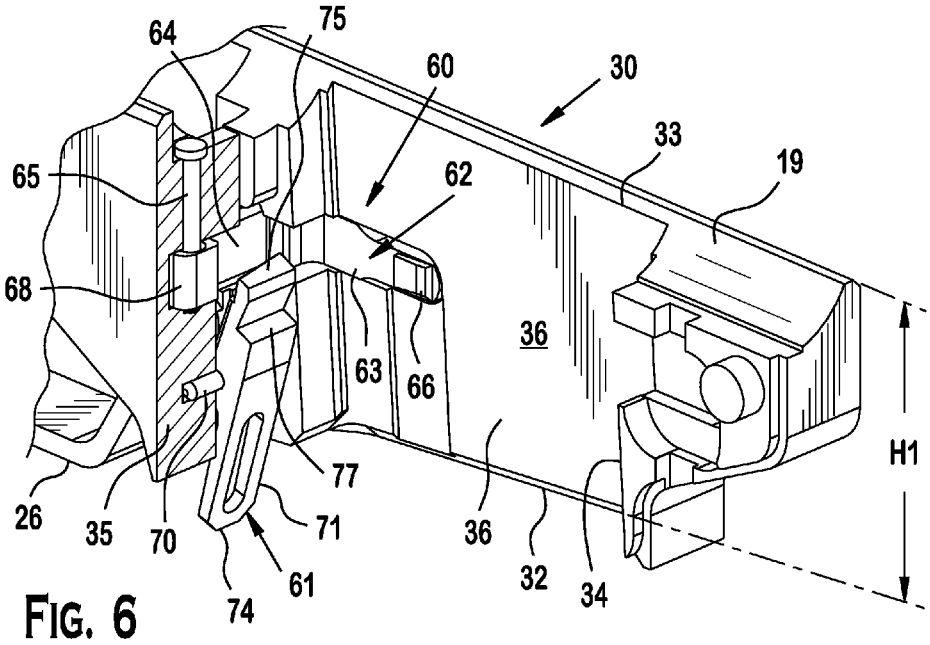
FIG. 6 is a partial cross-sectional side perspective view of the magazine well and magazine latch mechanism.
Figure 7:
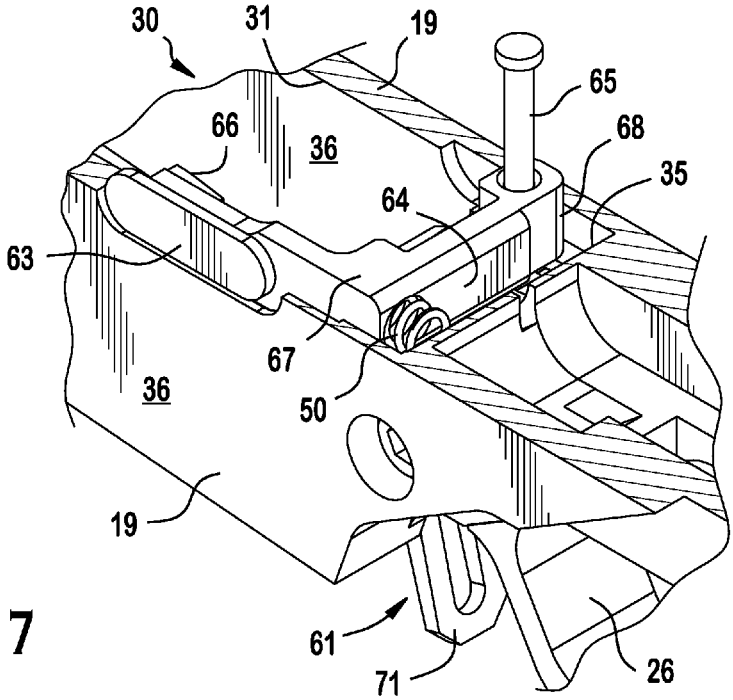
FIG. 7 is a partial cross-sectional top perspective view of the magazine well and magazine latch mechanism.

With continuing reference to FIGS. 2, 6, and 7, the rear catch lever 61 is mounted via a horizontal transversely mounted pivot pin 70 to rifle 20. In certain embodiments, pin 70 may be mounted proximate to rear wall 35 of magazine well 30 on either the rear wall or the lower receiver frame 19 between the trigger 27 and the rear wall so that the latching portion 72 of the rear catch lever is positioned to engage/disengage a magazine inserted in the magazine well. Pin 70 defines a horizontally oriented pivot axis providing a vertical pivoting action to the rear catch lever 61.

In one embodiment, pivot pin 70 with corresponding pivot axis is preferably located below the side catch lever 62 (best shown in FIGS. 2 and 6) by a sufficient vertical distance that provides rearward axial movement of the upper rear catch lever latching portion 72 to both: (1) cleanly engage and disengage the rear catch or lip 101 or I 11 of rear catch style magazines 100 or front catch style magazines 110, respectively, and (2) to properly actuate the side catch lever 62 to cleanly engage and disengage the side latch opening 121 of side catch style magazines 120 as further described herein. In one non-limiting exemplary embodiment, rear catch lever 61 may be centered on the magazine well 30 between the lateral sidewalls 36 of the magazine well for proper positioning to engage the rear lips of a rear or front catch style magazine.

FIGS. 17-23 show the rear catch lever 61 isolated and in more detail. Rear catch lever 61 has an elongated body including an operating portion 71 disposed below pin 70 and a latching portion 72 above the pin (see also FIGS. 6, 8, and 16). Operating portion 71 extends from bottom end 74 of the rear catch lever 61 to pin 70. Latching portion 72 extends from a top end 73 of the rear catch lever 61 to pin 70. In one embodiment, the operating portion 71 may have a longer length (measured vertically when rear catch lever 61 is mounted on magazine well 30) than the latching portion 72 to provide increased leverage for positively actuating and displacing the side catch lever 62 to engage and disengage a magazine, as further described herein. Operating portion 71 may include a textured surface (e.g. ridges, knurling, etc.) to provide slip resistant surface for facilitating positive engagement and operation by the user's finger or thumb. In other embodiments, the surface may be smooth.

Rear catch lever 61 includes a mounting hole 80 for inserting pivot pin 70 to mount the lever to the frame 19. In one non-limiting embodiment, a pair of laterally spaced mounting holes 80 may be provided as shown each formed on one of a pair of horizontally spaced apart flanges 81. A centerline CL is defined for reference which passes through the hole 80 from the top end 73 to the bottom end. In one embodiment, rear catch lever 61 may have an asymmetric shape in side view (see, e.g. FIGS. 20 and 22) with the top end 73 defined by the latching portion 72 may be longitudinally offset from centerline CL and bottom end 74 defined by the operating portion 71 of the rear catch lever 61. This permits the position of the operating portion 71 of the rear catch lever to be located closer to the rear wall 35 of the magazine well 30 to prevent inadvertent activation of the lever while preserving maximum leverage to positively engage or disengage a magazine 100 or 110 (see, e.g. FIGS. 8 and 9).

The latching portion 72 is configured to engage a retention feature or catch such as a protruding lip formed on a rear wall of a front or rear catch style magazine. In one embodiment, latching portion 72 is specially configured to engage the rear lips 101, 111 of both rear and front catch style magazines 100, 110, respectively (see, e.g. FIGS. 8-11). The rear lip 111 on a front catch style magazine 110 (see also FIG. 4) is generally located at a higher location or elevation on the magazine than the rear lip 101 on a rear catch style magazine 100 (see also FIG. 3), as measured from a common reference line in the receiver. The most appropriate reference line would be the centerline CLR of the upper receiver 24 which coincides with the longitudinal axis LA defined by the barrel 21 of the rifle 20 into which a cartridge is fed by the action (e.g. bolt 29). In order to properly present the top cartridge in any magazine to the reciprocating bolt 29 for loading into the open rear of the barrel chamber 18 when the action is cycled either manually or automatically, it is therefore necessary that the top of the magazine generally consistently falls at a location in the receiver 22 slightly below the centerline CLR to upload and present that cartridge at centerline CLR of the upper receiver 24 for chambering regardless of whether a rear, front, or side catch style magazine is used. This allows the bolt to travel over the magazine during cycling of the action and consistently strip and properly load the top exposed cartridge from the magazine into the barrel without jamming the action.

In certain embodiments, for example, the vertical distance D1 measured from the upper receiver centerline CLE to the middle of the side latch opening 121 of a side catch style magazine 120 is about 1.59 inches (reference FIG. 5). The distance D2 for the rear lip 101 on magazine 100 (AICS rear catch style magazine) is about 1.93 inches below the center line CLR. The distance D3 for rear lip 111 on magazine 110 (M14 front catch style magazine) is about 1.61 inches. All of these distances may vary slightly depending on bolt and receiver geometry and magazine angle.

With continuing reference to FIGS. 17-23, the latching portion 72 of rear catch lever 61 includes an inner surface 78 which faces towards the magazine well 30 and a magazine 100, 110, or 120 when mounted therein. In order to accommodate the rear lips 101 and 111 of both front and rear catch style magazines 100 and 110 as discussed above, the inner surface 78 may include a stepped structure 76 defining a first lower shoulder or ledge 77 and a second upper shoulder or ledge 75. Upper ledge 75 may be disposed adjacent to and/or at the top end 73 of the rear catch lever 61. When the rear catch lever 61 is pinned to the rear wall 35 of magazine well 30, the lower ledge 77 is positioned to engage a lip 101 on a rear catch style magazine 100 if inserted in the magazine well (see, e.g. FIG. 8), and the upper ledge 75 is positioned to engage a lip 11 on a front catch style magazine 110 if inserted in the magazine well (see, e.g. FIG. 10). Accordingly, rear catch lever 61 is operable to lockingly engage both rear and front catch style magazines using a single pivoting lever.

Rear catch lever 61 is pivotably movable between a latched position engaged with rear lip 101 or 111 of the magazines 100 or 110 respectively (see, e.g. solid lines latching portion 72 and operating portion 71 in FIGS. 8 and 9 or 10 and 11, respectively) to retain the magazines in the magazine well 30, and an unlatched position disengaged from the rear lip 101 or 111 of the magazines 100, 110 respectively (see, e.g. dashed lines latching portion 72' and operating portion 71' in FIGS. 8 and 9 or 10 and 11, respectively) to release the magazine from the magazine well. When engaged with either of the foregoing two types of magazines, the operating portion 71 of rear catch lever 61 is horizontally spaced farther from the magazine well 30 than the latching portion 72 when the rear catch lever is in the latched position.

Rear catch lever 61 is normally biased into the latched position by a spring 79. In one non-limiting embodiment, spring 79 may be a torsion spring mounted about pivot pin 70 (as shown herein) and is axially aligned with the longitudinal axis of the lower receiver (housing) 24. Other types of springs may be used. For example, a helical compression spring may be used to act on latching portion 72 to push it forward towards the magazine and the latched position. Accordingly, numerous types and arrangements of springs are possible. Spring 79 has a sufficient spring force k selected to maintain positive engagement between the latching portion 72 of the rear catch lever and the magazine 100 or 110 during normal handling and firing of the rifle 20. At the same time, the spring force k should not be so large as to cause the user or operator to use excessive force to release the magazine from the magazine well. It is well within the ambit of one skilled in the art to select an appropriate type spring and corresponding spring force k.

Figure 8:
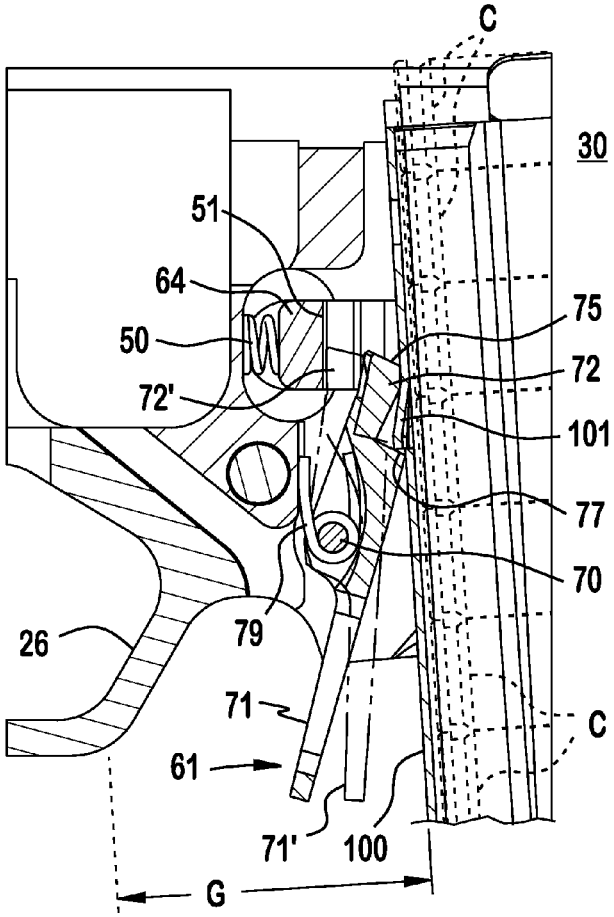
FIG. 8 is a partial cross-sectional side view of the magazine latch mechanism showing a latched position (solid lines) and an unlatched position (dashed lines) with the magazine of FIG. 3.
Figure 9:
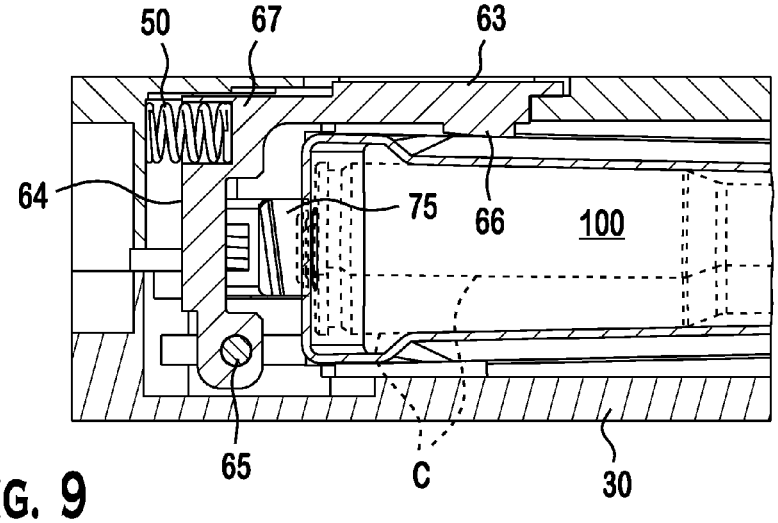
FIG. 9 is a partial cross-sectional top view of the magazine latch mechanism showing a latched position (solid lines) and an unlatched position (dashed lines) with the magazine of FIG. 3.
Figure 10:
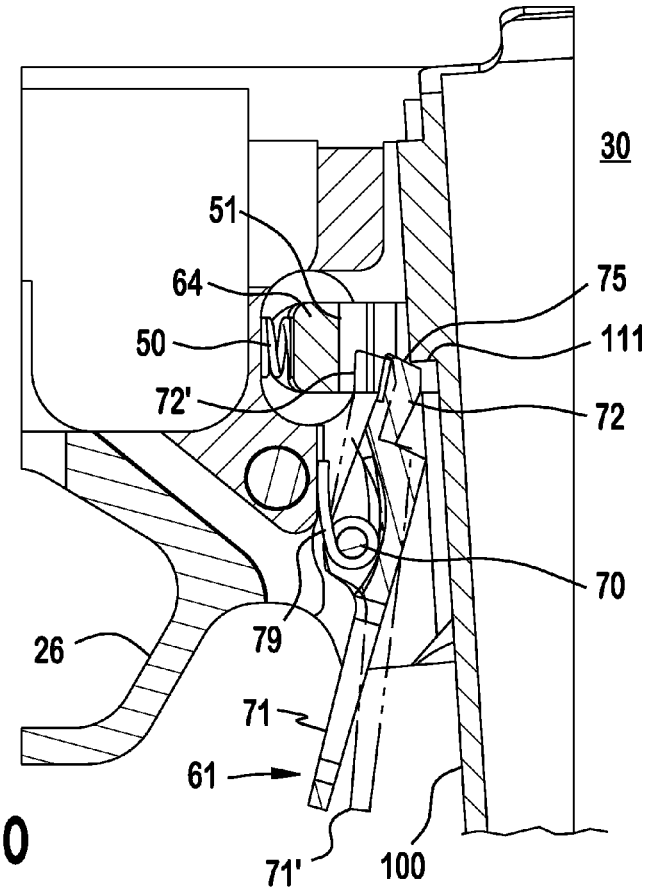
FIG. 10 is a partial cross-sectional side view of the magazine latch mechanism showing a latched position (solid lines) and an unlatched position (dashed lines) with the magazine of FIG. 4.

To operate the rear catch lever 61 and release a magazine from the magazine well 30, the operating portion 71 is pressed towards the magazine well 30 by the user's finger or thumb (see dashed line operating portion 71' in FIG. 8 or 10). This pivots the rear catch lever 61 about its pivot axis which moves horizontally to disengage the latching portion 72 (i.e. lower ledge 77 or upper ledge 75) from beneath the magazine's rear lip 101 or 111 to release and drop the magazine 100 or 110 (see sold line latching portion 72' in FIG. 8 or 10).

The side catch lever 62 will now be further described. Referring to FIGS. 2, 6-7, and 12-16, the side catch lever 62 is mounted via a vertical transversely mounted pivot pin 65 to the rifle 20. In one embodiment, pin 65 may be mounted to the frame 19 defined by lower receiver 24 or the magazine well 30. Pin 65 is preferably located behind rear wall 35 of the magazine well and proximate to one of two rear corners 37 formed between rear wall 35 and sidewalls 36 of the magazine well 30. Pin 65 defines a vertically oriented pivot axis providing a horizontal pivoting action to the rear catch lever 61. Pin 65 is preferably located laterally adjacent on one side or the other of the rear catch lever 61. In one embodiment, the pin 65 is mounted via a hole 82 in the terminal free end 68 of the operating arm 64 of side catch lever 62.

Side catch lever 62 may have an L-shaped body including an operating arm 64 and a latching arm 63 joined together at their intersection by elbow 67 (see also FIGS. 24-28). Side catch lever 62 may be horizontally oriented when mounted to rifle 20. Operating arm 64 extends horizontally and laterally from elbow 67 in a transverse or perpendicular direction to the longitudinal axis LA adjacent to and along rear wall 35 of magazine well 30. Latching arm 63 extends forward in an axial direction parallel to longitudinal axis LA along one of the lateral sidewalls 36 of the magazine well 30. Elbow 67 is preferably positioned near the rear corner 37 of magazine well 30 opposite the pivot pin 65. Elbow 67 may be positioned slightly behind and laterally beyond the sidewall 36 to enable the latching arm 63 of the side catch lever 62 to properly engage and release the side catch style magazine 120 when inserted in the magazine well, as shown in the drawings.

The latching arm 63 of side catch lever 62 is configured to engage a side retention feature or catch such as latch opening 121 formed in one of the lateral sides 124 of side catch style magazine 120 (see also FIG. 5). In one embodiment, the latching arm 63 includes an inward projecting latching protrusion 66 disposed proximate to its terminal free end 69 on an inner surface 52 of the latching arm. Protrusion 66 is laterally and transversely movable into and out of latch opening 121 to engage and disengage the magazine 120, respectively. Accordingly, side catch lever 62 is pivotably movable between a latched position engaged with latch opening 121 of the magazine 120 (see FIGS. 12-13) to retain the magazine in the magazine well 30, and an unlatched position disengaged from the latch opening 121 of the magazine to release the magazine from the magazine well (see FIGS. 14-15). In the unlatched position, the operating arm 64 is disposed an angle A1 to sidewall 124 of magazine 120, as shown in FIG. 15) being pivoted about pin 65. Angle A1 may be measured from the outer lateral surface of the operating arm 64.

Side catch lever 62 is normally biased into the latched position by a spring 50. In one non-limiting embodiment, spring 50 may be a helical compression spring mounted to the rear of and behind operating arm 64 of side catch lever 62 to bias the operating arm forward and axially towards the magazine well 30. An end of spring 50 may be received in a recess 83 formed in the rear surface 84 of the operating arm 64. Other types of springs may be used. For example, a torsion spring mounted about pivot pin 65 may be used. Accordingly, numerous types and arrangements of springs are possible. Spring 50 has a sufficient spring force k selected to maintain positive engagement between the latching arm 63 of the side catch lever and magazine 120 during normal handling and firing of the rifle 20. At the same time, the spring force k should not be so large as to cause the user or operator to use excessive force to release the magazine from the magazine well. It is well within the ambit of one skilled in the art to select an appropriate type spring and corresponding spring force k.

According to one aspect of the magazine latch mechanism 60, both the rear catch lever 61 and side catch lever 62 are actuated via the rear catch lever. The rear catch lever 61 is preferably pivotably mounted to the magazine well 30 below the side catch lever 62. This is necessary because the rear lip 111 location for latching front catch style magazines 110 to the magazine well 30 fall at approximately the same vertical location or height on the magazine as the side latch opening 121 in side catch style magazines (compare, e.g. FIG. 10 lip 111 to operating arm 64 of side catch lever 62 coinciding with elevation of latch opening 121). Therefore, the rear lip 111 on front catch style magazines 110 would be positioned between the rear operating arm 64 of the side catch lever 62 and rear wall 35. Accordingly, would be extremely difficult mechanically if not almost physically impossible in the present universal magazine latch mechanism 60 designed to accommodate both front and rear catch style magazines to use the side catch lever as a means for actuating the rear catch lever 61 without greatly increasing the complexity of the mechanism and the required motion of the side catch lever because there would be no effective lever arm (i.e. mechanical advantage) that would enable the side catch lever to pivotably move the rear catch lever for proper latching/unlatching action. Therefore, the contrast, the rear catch lever 61 in one preferred embodiment of the present magazine latch mechanism 60 is mounted below the side catch lever 62 and has a sufficient length to directly engage/disengage the rear lip 101 or 110 on either front or rear catch style magazines 100, 110 with a mechanical advantage while in turn actuating and operating the side catch lever.

Figure 12:
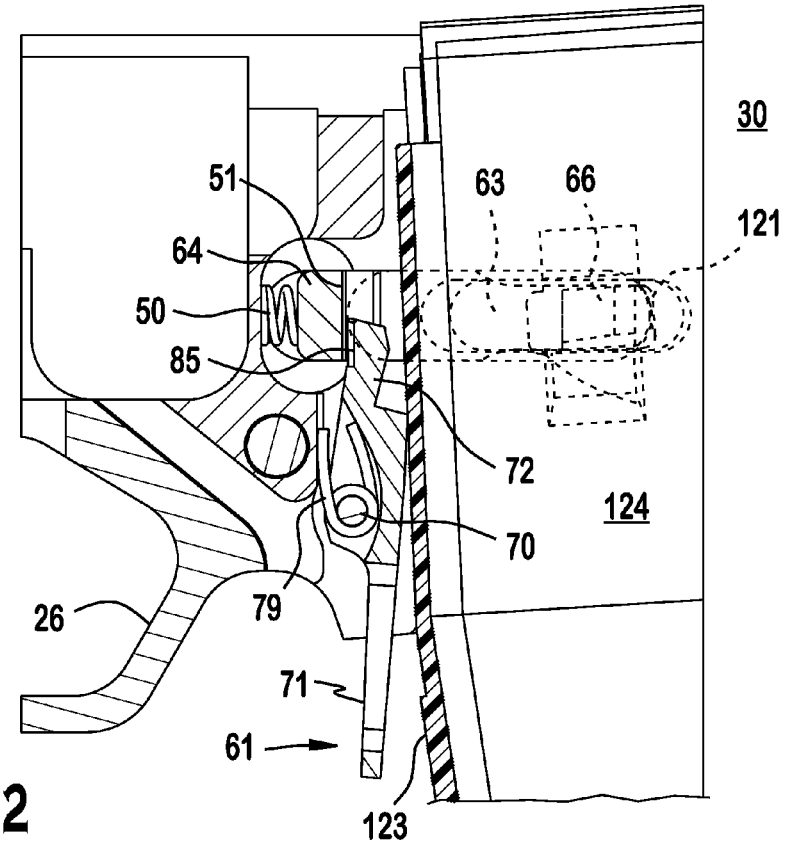
FIG. 12 is a partial cross-sectional side view of the magazine latch mechanism showing a latched position with the magazine of FIG. 5.

In view of the foregoing, the side catch lever 62 is actuated and operated by the rear catch lever 61 in a preferred embodiment. At least part of the latching portion 72 of rear catch lever 61 in a preferred embodiment is positioned between the operating arm 64 of the side catch lever 62 and the magazine well 30, as shown in FIGS. 6 and 12. The side catch lever 62 is operated and pivotably moved between the latched and unlatched positions by depressing operating portion 71 of the rear catch lever 62. This pivots the latching portion 72 of rear catch lever 61 axially rearward, which in turn engages and axially displaces the operating arm 64 of side catch lever 62 rearward by a substantially equal amount in the same direction. The side catch lever 63 pivots transversely and horizontally about pin 65 to move the lever into the unlatched position in which protrusion 66 is withdrawn from latch opening 121 of magazine 120, thereby releasing and dropping the magazine (see, e.g. FIG. 15). When the rear catch lever 61 is released by the user or operator, both the rear catch lever and the side catch lever 62 will return to their respective latched positions under the biasing force of springs 79 and 50, respectively. To enhance positive engagement between the rear catch lever 61 and side catch lever 62 during operation, a recessed pocket 51 (best shown in FIG. 24) may be disposed on the inner forward facing surface 53 of operating arm 64 which is configured to receive the upper section of the latching portion 72 of the rear catch lever.

Advantageously, it should be noted by placing pivot pin 65 and protrusion 66 on opposite sides of the longitudinal axis LA and magazine 120, the lever arm (mechanical advantage) is maximized thereby providing optimum lateral movement of the protrusion to positive engage or disengage the magazine 120. In addition, it further bears noting that the side catch lever 62 could not physically operate and pivotably move if the pivot pin 65 and protrusion 66 were instead placed on the same side of the longitudinal axis LA and magazine 120 (i.e. at opposite ends of the latching arm 63). Pressing the rear catch lever 61 would not move side catch lever 62 at all because the direction of the moment force on the side catch lever would act in the direction toward its latched position attempting to drive the protrusion 66 further into engagement with the magazine. The moment force on side catch lever 62 must necessarily act instead in the direction toward its unlatched position to disengage the protrusion 66 from the latch opening 121 of magazine 120 in order for the side catch lever to work properly for engaging/disengaging the magazine if the rear catch lever 61 is used to actuate the side catch lever as in the present design.

Figure 19:
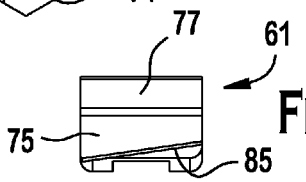
Figure 20:
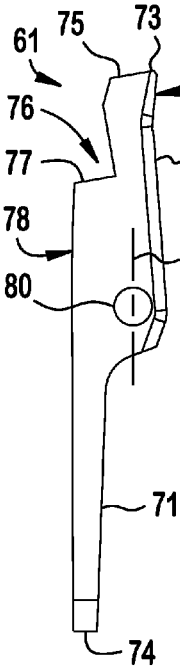
Figure 21:
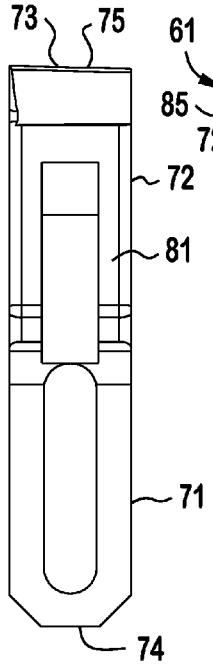
Figure 22:
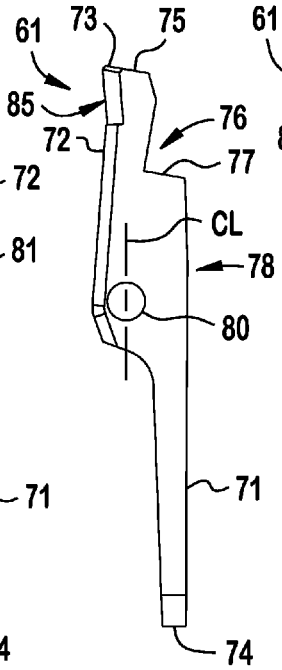
Figure 23:
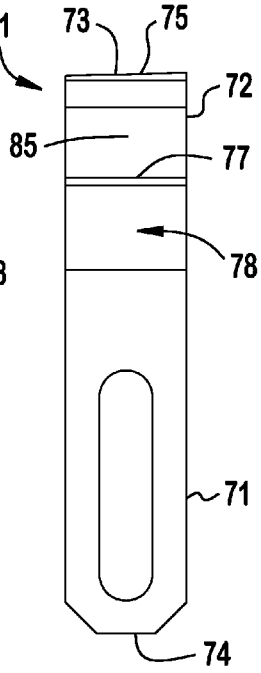
Figure 24:
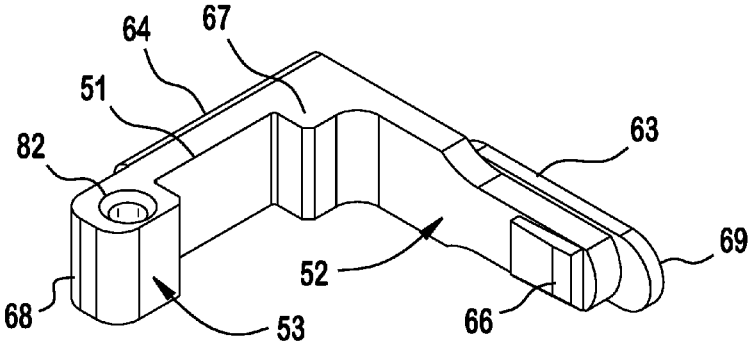
FIGS. 24-28 show various side, top, and perspective views of a first embodiment of a side catch lever of the magazine latch mechanism.
Figure 25:
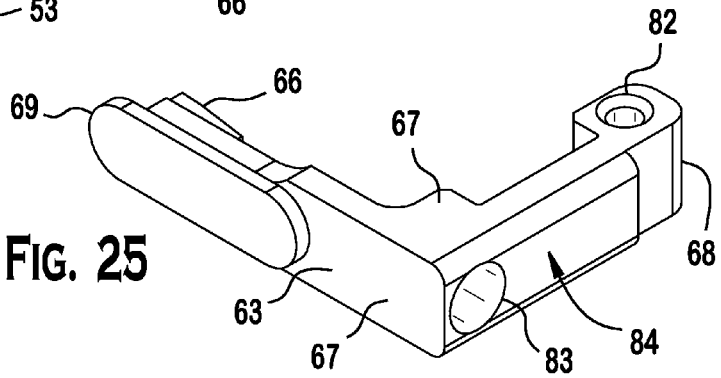
Figure 26:
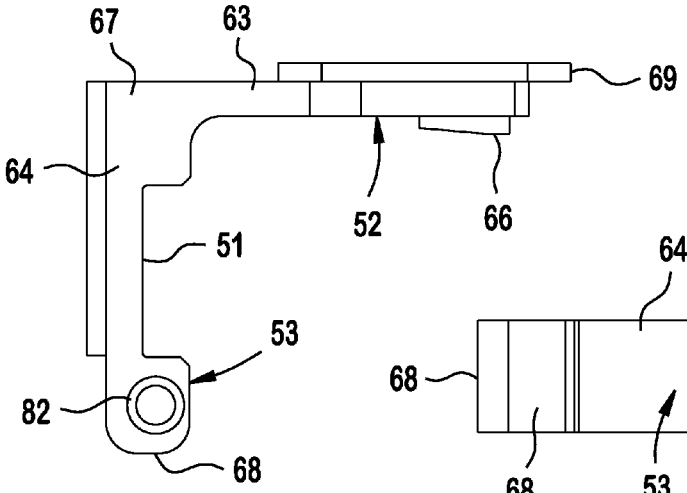
Figure 27:
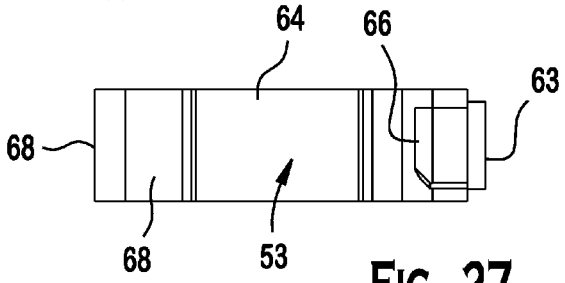
Figure 28:
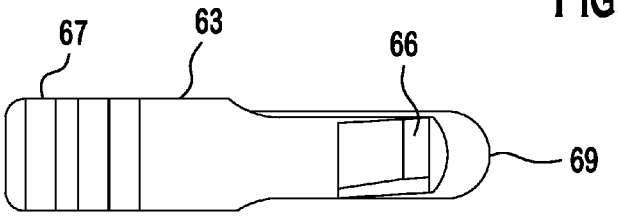
Figure 29:
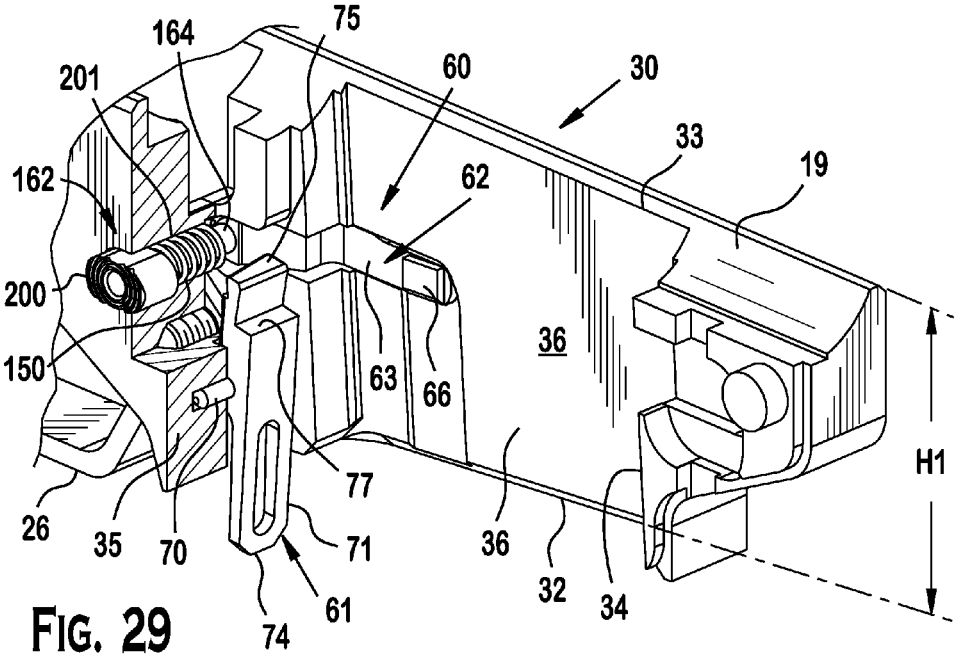
FIG. 29 is a partial cross-sectional side perspective view of the magazine well showing a magazine latch mechanism according to a second embodiment of the present invention.
Figure 30:
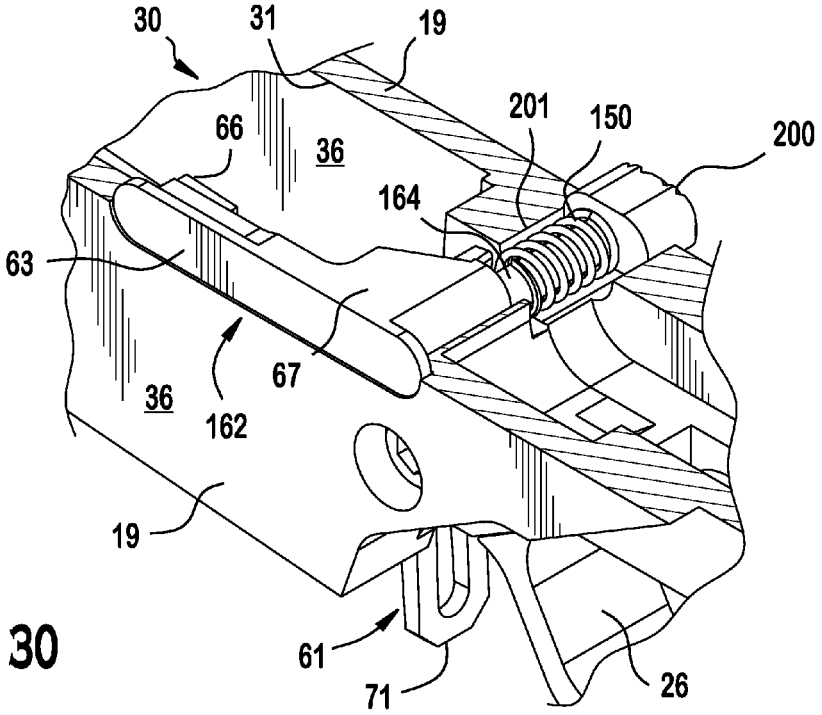
FIG. 30 is a partial cross-sectional top perspective view thereof.

In one embodiment, the rear facing bearing surface 85 on the latching porting 72 of rear catch lever 61 that contacts the side catcher lever 62 may be configured to ensure that it maintains contact with the point farthest from the pivot 65 of the side catch lever (closest to latching arm 63) for maximum leverage (in the horizontal plane). In one configuration, the left lateral portion of bearing surface 85 that contacts the forward facing surface in pocket 51 of the side catch lever operating arm 64 may be angled to ensure that it maintains contact with the point farthest from the pivot of the side catch lever for maximum leverage. FIGS. 12-15 best illustrate this manner of mutual engagement. Bearing surface 85 may be configured and arranged on rear catch lever 61 to continuously maintain contact with operating arm 64 of side catch lever 62 in some embodiments during the movement of the side catch lever between the latched and unlatched positions. In one exemplary embodiment, bearing surface 85 may be asymmetrically shaped having an inclined or angled surface shape (shown in detail in FIGS. 17-23). As best shown in FIG. 19, bearing surface 85 may be angled or inclined between 0 and 90 degrees in one direction with respect to a vertical plane (e.g. using inner surface 78 of the rear catch lever operating portion 71 as the vertical reference plane as identified in FIG. 20). In some embodiments, bearing surface 85 may be angled or inclined between 0 and 90 degrees in two directions with respect to a vertical plane (e.g. using again inner surface 78 of the rear catch lever operating portion 71 as a vertical reference plane). In this latter embodiment, the top edge of the bearing surface 85 adjacent top end 73 and upper ledge 75 of the rear catch lever 61 is farther from the centerline CL of the lever than the bottom edge so that the top edge is angled away from centerline CL (see, e.g. FIG. 20). This creates substantially linear and/or point contact between bearing surface 85 and the operating arm 64 of side catch lever 62 during the mutual relative movement of both the rear and side catch levers 61, 62 between their respective latched and unlatched positions described herein. Instead of an angled surface configuration, a protrusion such as a raised bump, peak, nub may be provided on the side portion of bearing surface 85 farthest from the pivot pin 65 to produce the same maximum leverage results.

Using a lever such as rear catch lever 61 positioned at the rear of the magazine to release the magazines has many benefits. The lever can be centrally located for ambidextrous operation, and can be actuated using the firing hand with minimal movement. The lever can also provide increased mechanical advantage, allowing heavier springs to be used for better retention, while enabling easy removal. Reducing the force required to release the magazines and allowing easy access with either hand and thumb or index fingers is important for a rifle that could be shot from many positions. The length and angle of the lever can be adjusted to suit user preference and increase design flexibility. In some designs a magazine well 30 with increased depth is desirable, and the lever can be lengthened as needed, without compromising the stability or strength of the mechanism. Because some magazines are only designed with a rear catch, the lever at the rear enables more magazines to be used and it simplifies the operation for those magazines. The lever can be designed to allow the release of rear catch magazines before contacting the side catch, which reduces force and wear. Because the rear catch on an M1A/M14 magazines is at nearly the same height as the side catch, it would be difficult to engage the rear catch without using a separate lever like rear catch lever 61 as shown and described herein. The location of the Accuracy International Short Action (AICS) style catch, approximately 0.300" below the M1A/M14 catch, is another reason why the independent vertical lever is the preferred method as it would be difficult and complicated to retain this using the side catch mechanism The rear located lever, with its high mechanical advantage, also enables the design of a side-catch release with true side-to-side motion. One additional benefit of this configuration is that a standard side catch release button could also be placed on the right side of the action in addition to the side catch lever 62 on the left side, thereby providing two release methods for side catch style magazine (i.e. right or left latch openings). In other configurations, it may be desirable to only enable the rear catch lever 61 to operate the side catch lever 62 so that the operator would not have to remember what kind of magazine was installed to release the magazine.

The rear catch lever 61 and side catch lever 62 may be made from any suitable rigid metal or non-metal material. In various embodiments, the catch levers may be made for example of steel, titanium, aluminum, or a suitably strong unreinforced or reinforced polymer (e.g. glass filled nylon) with suitable rigidity in structure to minimize flexure during operation. In some preferred embodiments, both levers may be made of a steel alloy capable of being hardened to at least 40 HRc, such as without limitation either carbon steel or stainless.

In certain embodiments, the rear catch lever 61 and side catch lever 62 with their respective sub-parts described herein (e.g. operating arms/portions, latching arms/portions, latch protrusion, etc.) may each be formed as a single unitary part regardless of the fabrication method used to form the levers (e.g. molded, cast, forged, and/or other).

Pivot pins 65 and 70 may preferably be made of metal, such as steel, aluminum, or titanium as some non-limiting examples. Springs 50 and 79 may be made of a suitable spring steel.

Figure 13:
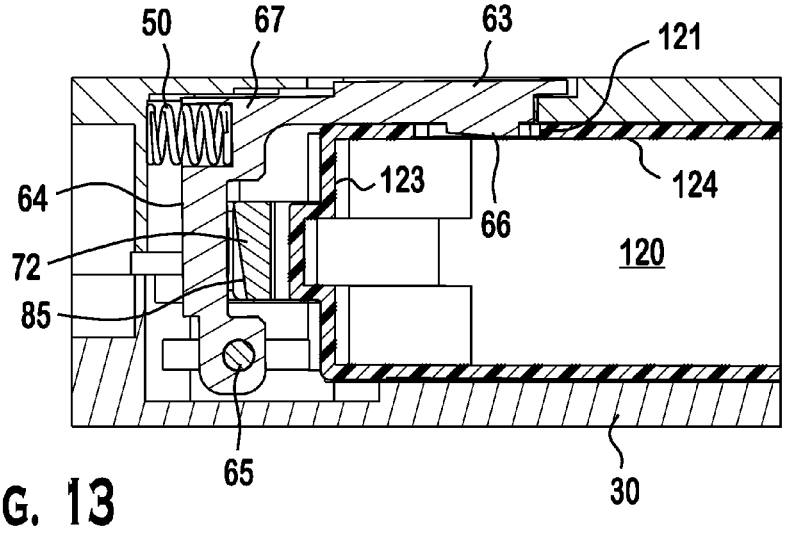
FIG. 13 is a partial cross-sectional top view of the magazine latch mechanism showing a latched position with the magazine of FIG. 5.

In one operating scenario to demonstrate use of the magazine latch mechanism 60, a side catch style magazine 120 having a side catch feature such as latch opening 121 (see, e.g. FIG. 5) is first inserted into magazine well 30. The upper end 125 of the magazine 120 contacts the latching protrusion 66 on latching arm 63 of the side catch lever 62. This may slightly automatically displace the latching arm 63 laterally outwards away from the magazine well 30 towards the unlatched position during which time the magazine remains in contact with the latching protrusion 66 as one side 124 of the magazine slides along the protrusion. When the magazine 120 is inserted sufficiently far into the magazine well 30, the latching protrusion 66 will eventually reach and engage the latch opening 121 in the magazine and snap back into the latched position under the biasing force of spring 50, thereby retaining the magazine in the magazine well (see FIGS. 12-13 showing the side catch lever in the latched position). Due to the arrangement of the rear catch lever 61 and side catch lever 62 in the embodiment described herein, it bears noting that inserting the magazine 120 with side catch feature into the magazine well does not substantially move or pivot the rear catch lever by a significant amount to fully actuate the lever from the latched to unlatched position described herein. The side catch lever 62 is manually operated by pushing or depressing the operating portion 71 of the rear catch lever 61 and not vice-versa. So lateral displacement of the latching arm 63 of the side catch lever does not move the rear catch lever into its unlatched position. In addition, the side catch style magazine 120 has no protruding retention features on the rear 123 which might engage and pivot the rear catch lever 61 into its unlatched position during insertion of the magazine in the magazine well in the first place.

Figure 14:
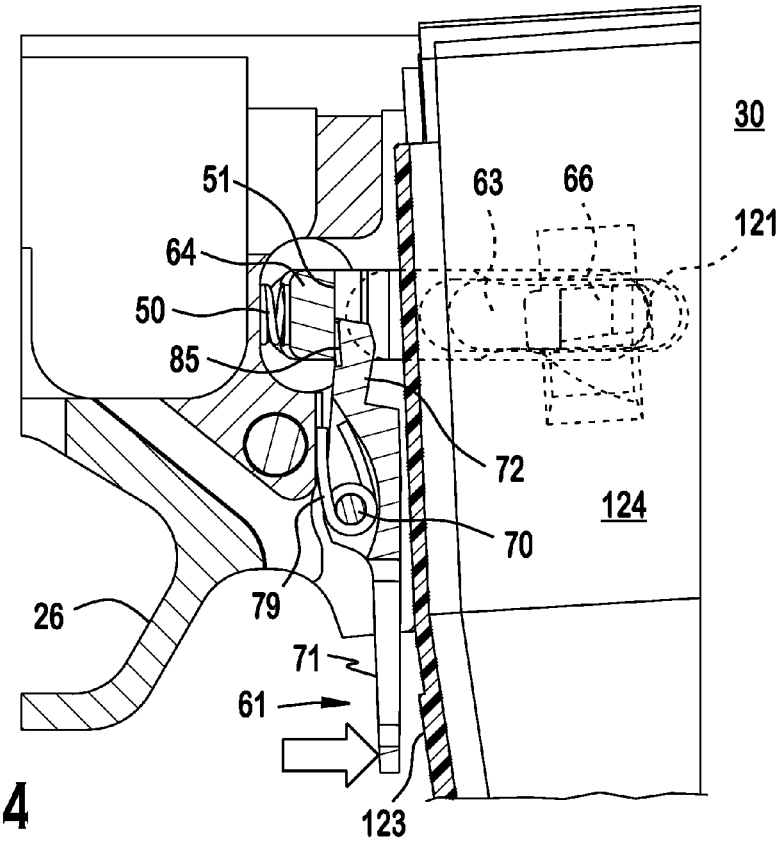
FIG. 14 is a partial cross-sectional top view of the magazine latch mechanism showing an unlatched position with the magazine of FIG. 5.
Figure 15:
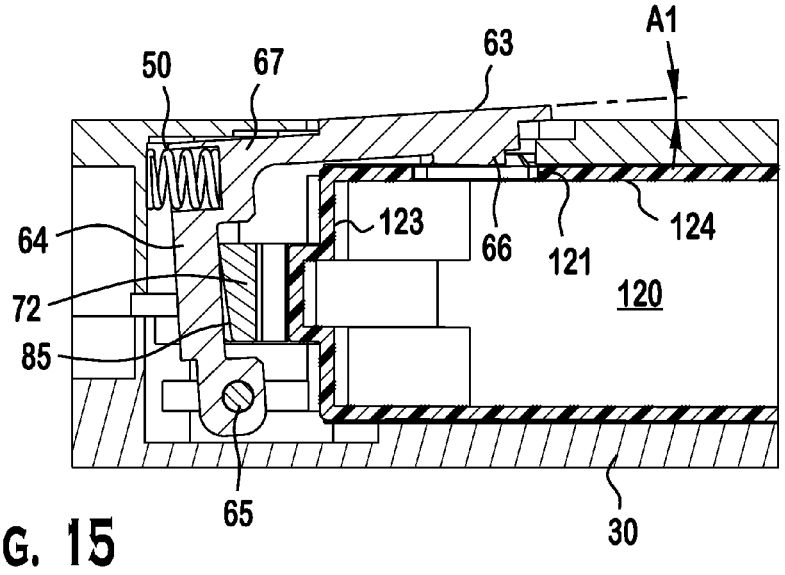
FIG. 15 is a partial cross-sectional top view of the magazine latch mechanism showing an unlatched position with the magazine of FIG. 5.
Figure 16:
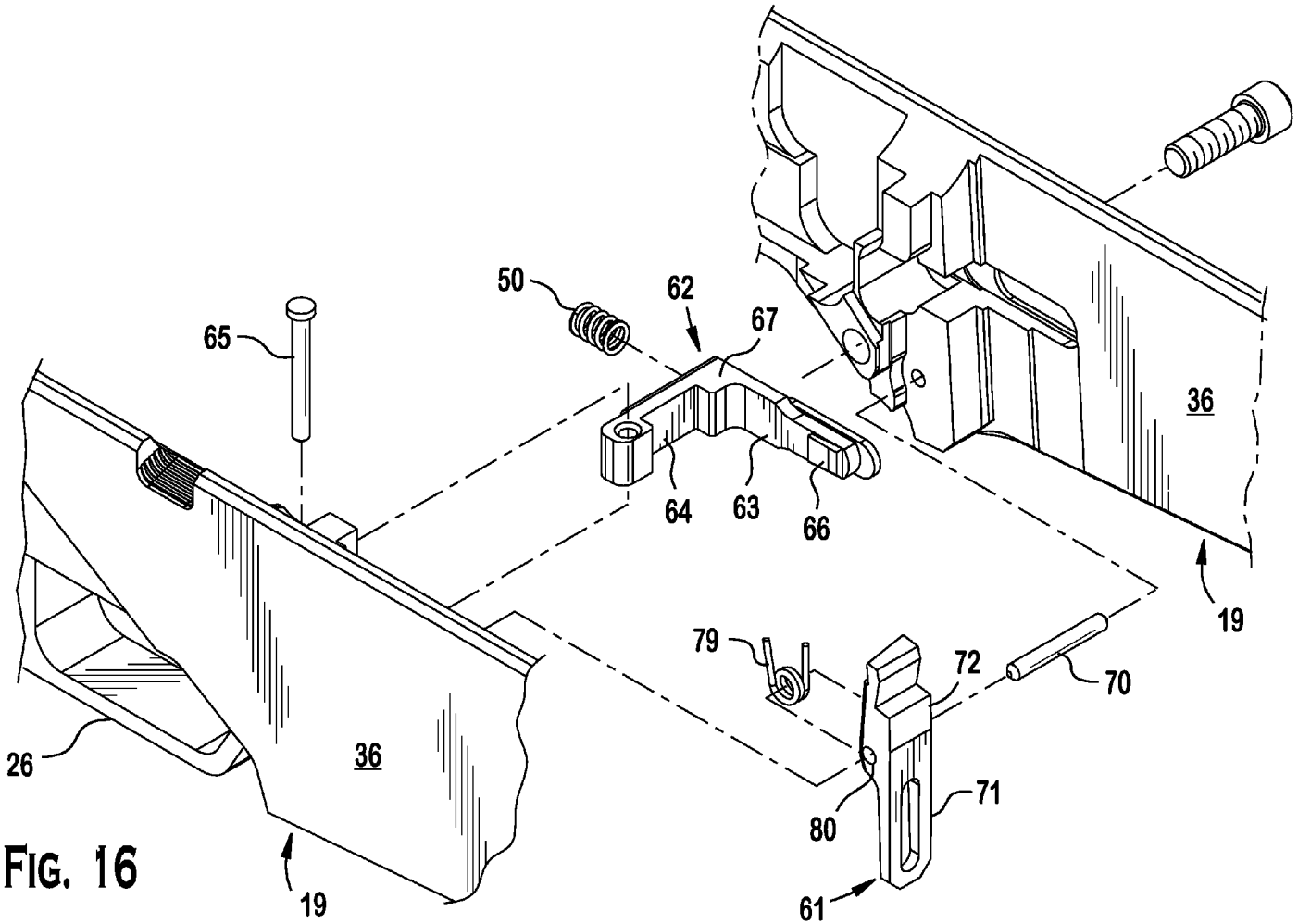
FIG. 16 is an exploded perspective view of the magazine latch mechanism.
Figure 17:
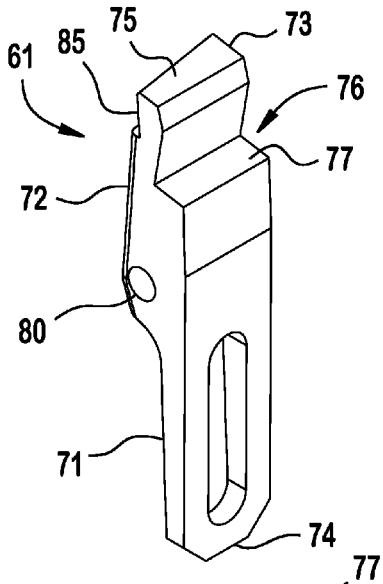
FIGS. 17-23 show various side, top, and perspective views of a first embodiment of a rear catch lever of the magazine latch mechanism.
Figure 18:
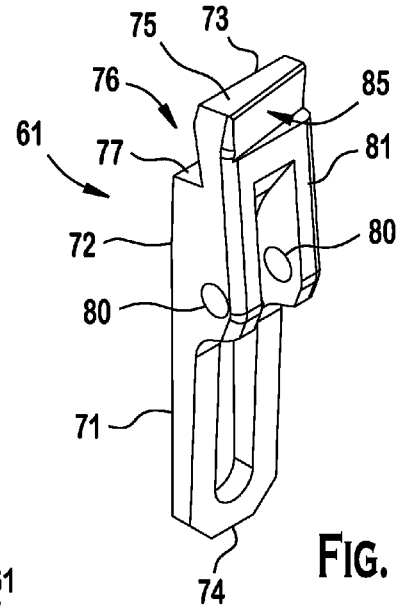

To remove magazine 120 from the magazine well 30 as shown in FIGS. 14 and 15, a user manually pushes or depresses the lower operating portion 71 of the rear catch lever 61 in a forward axial direction towards the magazine well which initially starts in its latched position. This pivots the upper latching portion 72 of the rear catch lever outwards and away from the magazine well in an opposite rearward axial direction, thereby moving the rear catch lever 61 to its unlatched position (shown in FIGS. 14 and 15). During the process, the top end 73 of the latching portion 72 enters recessed pocket 51 in the operating arm 64 of the side catch lever 62 driving the operating arm axially rearward as well. The side catch lever 62 pivots horizontally/transversely about its pivot axis (i.e. pivot pin 65) which laterally displaces the latching arm 63 of the side catch lever horizontally/transversely outwards away from the magazine well 30. The latching protrusion 66 is laterally withdrawn and disengages the lateral or side latch opening 121 in magazine 120, thereby releasing and dropping the magazine from the magazine well 30. The user preferably continues to depress and hold the rear catch lever 61 in the unlatched position until the magazine 120 is completely withdrawn from the magazine well. Thereafter, the user releases the rear catch lever 61 which automatically returns to its latched position under the biasing force of spring 79. The side catch lever 62 in turn automatically returns to its latched position (see FIGS. 12 and 13) under the biasing force of spring 50, thereby causing the latching arm 63 to move laterally in an opposite direction towards the magazine well. The magazine latch mechanism 60 is now ready to receive another magazine 120 or a different magazine such as magazines 100 or 110.

Figure 11:
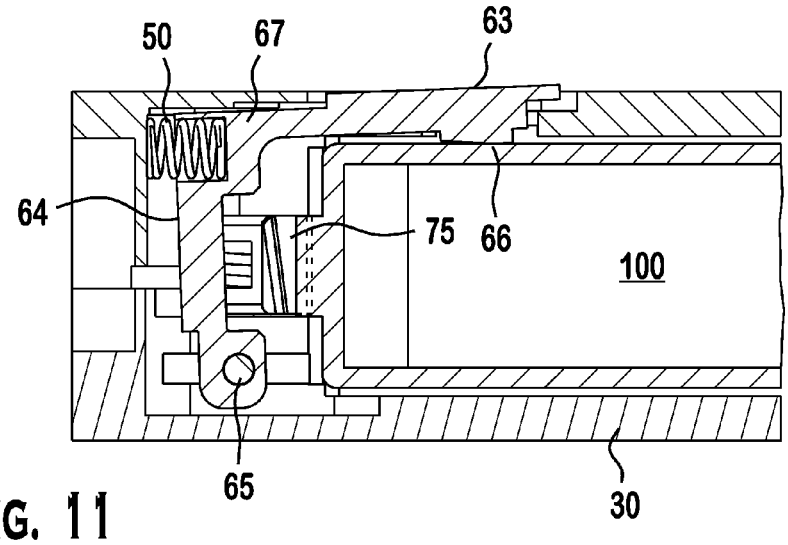
FIG. 11 is a partial cross-sectional top view of the magazine latch mechanism showing a latched position (solid lines) and an unlatched position (dashed lines) with the magazine of FIG. 4.

In another operating scenario to demonstrate use of the magazine latch mechanism 60, a rear catch style magazine 100 having a rear catch feature such as protruding lip 101 (see, e.g. FIG. 3) is first inserted into magazine well 30. Referring to FIGS. 10 and 11, the upper end 105 of the magazine 100 contacts the latching portion 72 of the rear catch lever 61. This may slightly automatically displace the latching portion 72 of rear catch lever 61 axially rearward and outwards away from the magazine well 30 towards but not reaching the unlatched position during which time the magazine remains in contact with the latching portion 72 as the rear wall 103 of the magazine slides along the protrusion. When the magazine 100 is inserted sufficiently far into the magazine well 30, the lower ledge 77 of the latching portion 72 will eventually reach and engage the lip 101 on the magazine causing the rear catch lever to snap back into the latched position beneath the lip under the biasing force of spring 79, thereby retaining the magazine in the magazine well (see FIGS. 10 and 11).

To remove magazine 100 from the magazine well 30, a user manually pushes or depresses the lower operating portion 71 of the rear catch lever 61 (which initially starts in its latched position engaged with magazine 100) again in a forward axial direction towards the magazine well 30. This pivots the upper latching portion 72 of the rear catch lever outwards and away from the magazine well in an opposite rearward axial direction, thereby moving the rear catch lever 61 to its unlatched position shown in FIG. 8 (see, e.g. dashed lines latching portion 72' and operating portion 71'). The lower ledge 77 on latching portion 72 of the rear catch lever 61 is axially withdrawn and disengages the rear lip 101 on magazine 100, thereby releasing and dropping the magazine from the magazine well 30. The user preferably continues to depress and hold the rear catch lever 61 in the unlatched position until the magazine 100 is completely withdrawn from the magazine well. Thereafter, the user releases the rear catch lever 61 which automatically returns to its latched position under the biasing force of spring 79.

A front catch style magazine 110 having both a front retention feature such as latch window 117 and a rear retention feature such as protruding lip 111 (see, e.g. FIG. 4) may be retained and released in the magazine well 30 in a similar foregoing manner to rear catch style magazine 100 because both magazines have a similarly protruding rear lips. The sole difference is that the upper ledge 75 formed on the latching portion 72 is used to engage the magazine lip 1 (see, e.g. FIG. 10) rather than the lower ledge 77 which is positioned to engage lip 101 on a rear catch style magazine 100 (see, e.g. FIG. 8). Otherwise, the foregoing process described for mounting and releasing magazine 100 in magazine well 30 would be the same including operation of the rear catch lever 61. For brevity, the process description will not be repeated.

FIGS. 29-47 show a second embodiment of a magazine latch mechanism 160 according to the principles of the present invention. In this embodiment, the side catch lever 162 is instead pushable and transversely slideable lever in lieu of having a pivoting action such as side catch lever 62 described above. The foregoing description of magazine latch mechanism 60 and its operation with all three types of magazines 100, 110, and 120 is substantially applicable to magazine latch mechanism 160. Those portions of the prior discussion will not repeated for brevity and similar elements are labelled the same. With that in mind, the following description will focus on the differences of the slide action side catch lever 162.

Some users that regularly use side catch style magazines may be accustomed to pushing a release switch cross-wise on their firearms to release the magazine. These users may be more comfortable using such a switch to release side catch style magazines. Magazine latch mechanism 160 to now be described provides this option for side catch style magazines while still maintaining the ability to release all three types of side, rear, and front style magazines using rear catch lever 61. Accordingly, magazine latch mechanism 160 advantageously provides additional user flexibility in operating the firearm's magazine latch mechanism.

FIGS. 43-47 show the reconfigured sliding cross-latch type side catch lever 162 in detail. Referring now to FIGS. 29-47, the sliding cross latch style side catch lever 162 of magazine latch mechanism 160 now includes a cylindrical operating arm 164 configured for lateral transverse sliding action with respect to the rifle 20 and magazine well 30. A helical compression spring 150 is transversely mounted in lower receiver frame 19 and wound around operating arm 164 which retains the spring. The spring 150 has one end engaged with frame 19 and an opposite end engaged with an actuating button 200 mounted in a complementary configured aperture 201 in the side of the frame. In one embodiment, button 200 may have an oval shape as shown; however, other suitable shapes including polygonal (e.g. rectilinear, etc.) and non-polygonal shapes (e.g. circular, elliptical, etc.) may be used. The button 200 may be fixedly disposed on the terminal free end 168 of the operating arm 164. Spring 1509 laterally biases the actuating button 200 outwards from frame 19 and side catch lever 162 into the latched position in which latching arm is biased inwards against the lateral side of the frame 19 and magazine well 30 (shown for example in FIG. 32).

The cylindrical operating arm 164 is connected to latching arm 63 via elbow 67 similarly to operating arm 64 (see, e.g. FIGS. 24-28 for comparison). In one non-limiting embodiment, operating arm 162 may be an integral unitary part of side catch lever 162 being formed of a single piece of cast, molded, forged, or otherwise fabricated material. In other possible embodiments, the operating arm 164 may be a separate component rigidly affixed to the elbow 67. The latching arm 64 is substantially configured the same as already described including inward projecting latching protrusion 66 disposed proximate to its terminal free end 69 on an inner surface 52 of the latching arm.

Figure 32:
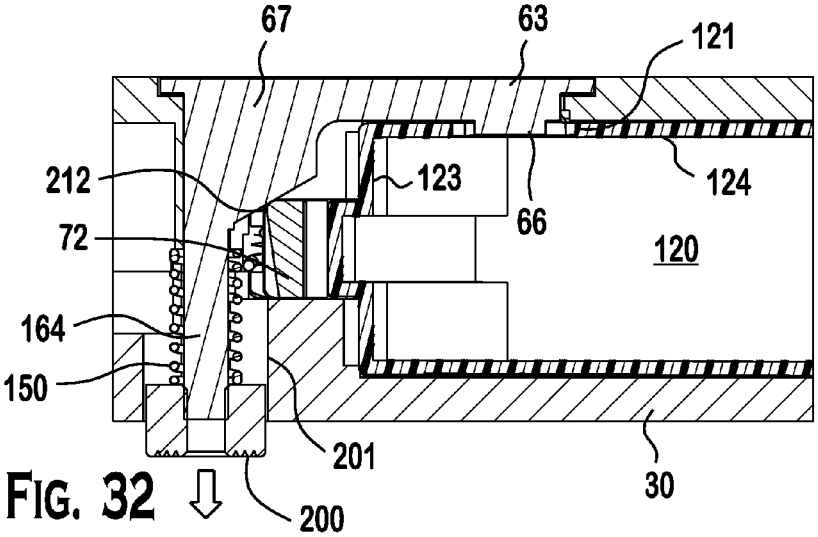
FIG. 32 is a partial cross-sectional top view of the second magazine latch mechanism showing a latched position with the magazine of FIG. 5.
Figure 33:
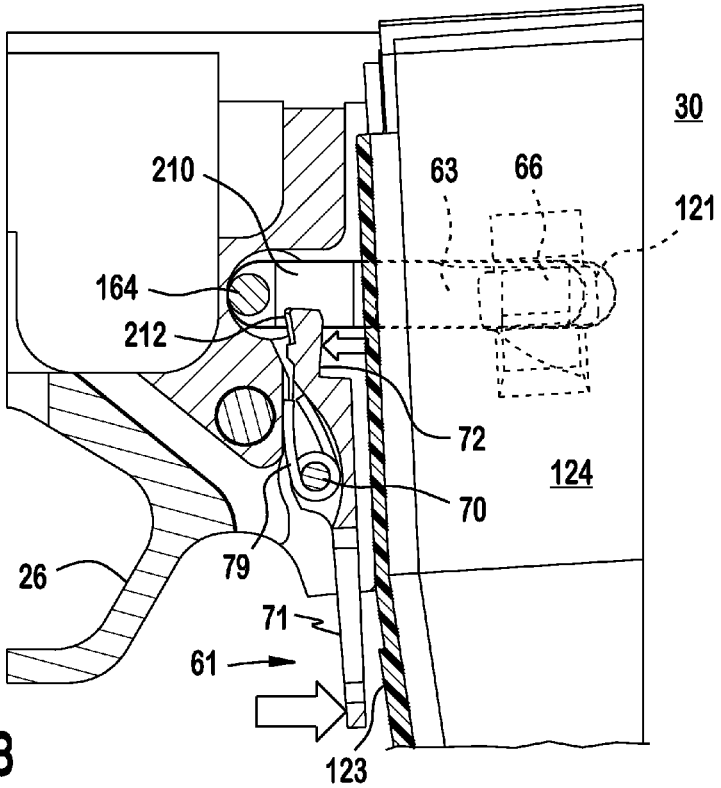
FIG. 33 is a partial cross-sectional top view of the second magazine latch mechanism showing an unlatched position with the magazine of FIG. 5.
Figure 34:
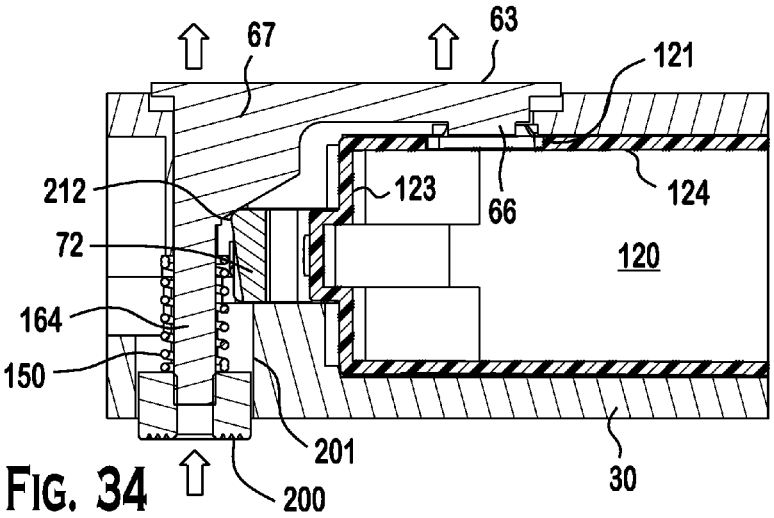
FIG. 34 is a partial cross-sectional top view of the second magazine latch mechanism showing an unlatched position with the magazine of FIG. 5.
Figure 35:
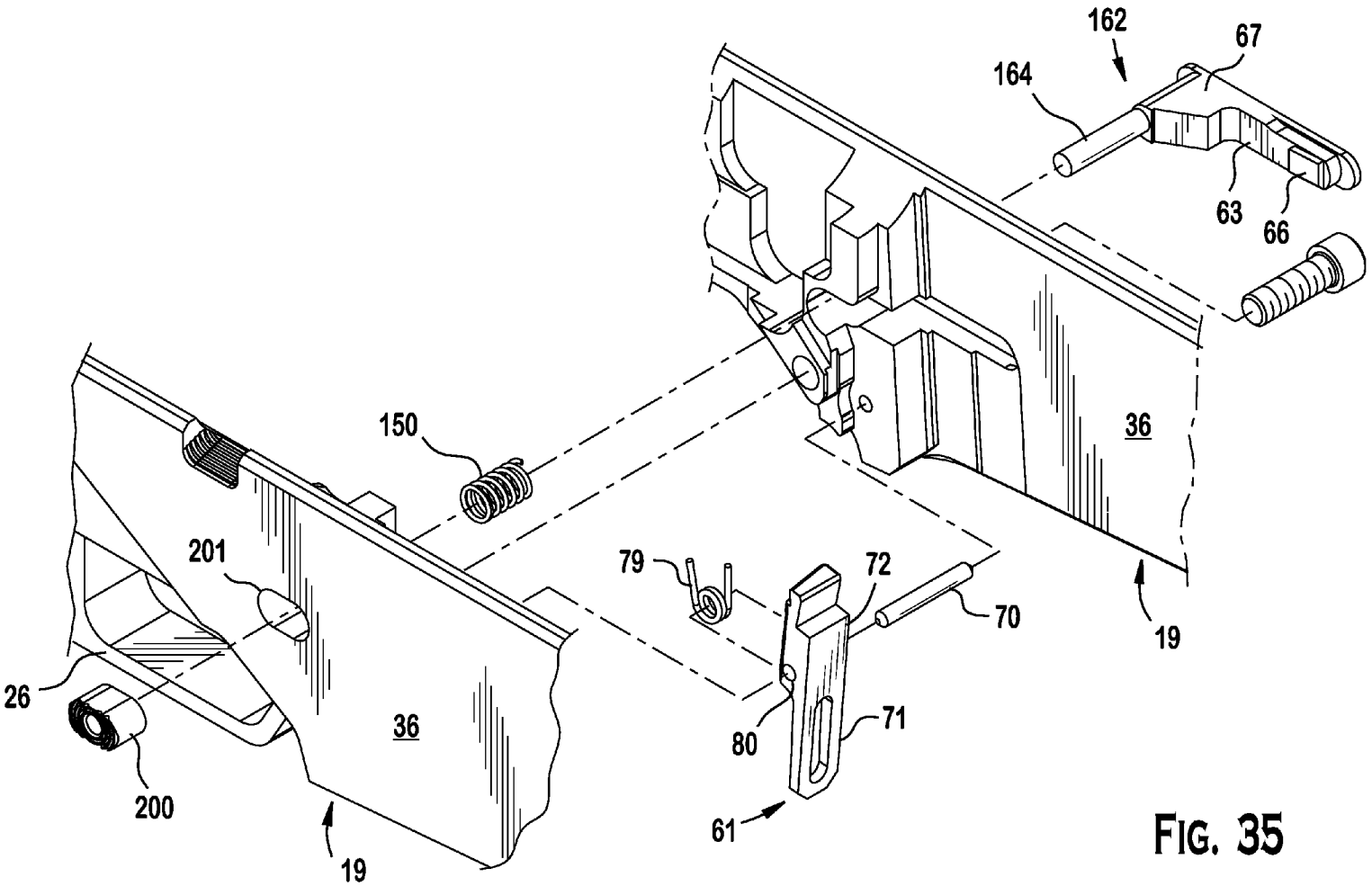
FIG. 35 is an exploded perspective view of the second magazine latch mechanism.
Figure 36:
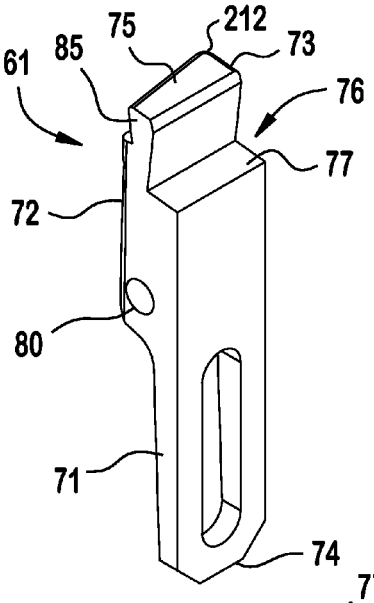
FIGS. 36-42 show various side, top, and perspective views of a second embodiment of a rear catch lever of the second magazine latch mechanism, the rear catch lever including a cam protrusion.
Figure 37:
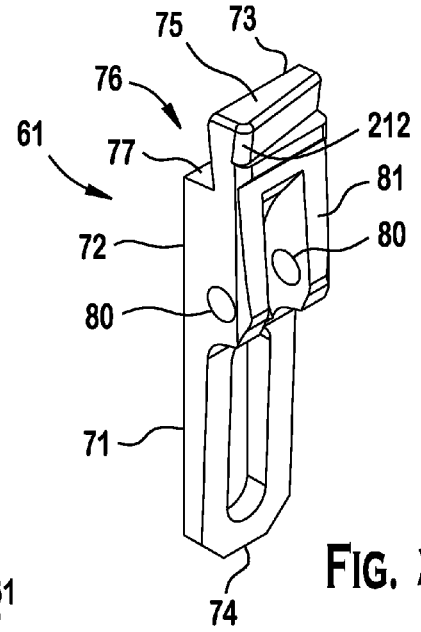
Figure 38:
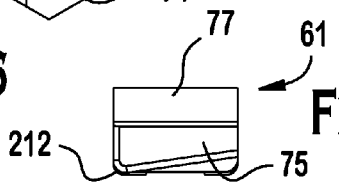
Figure 39:
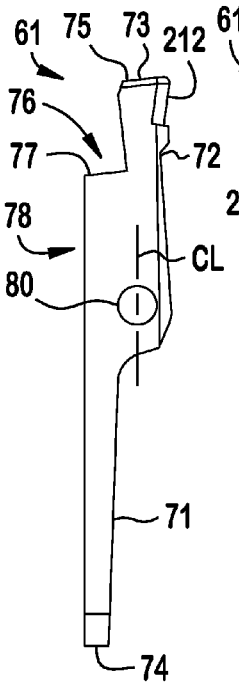
Figure 40:
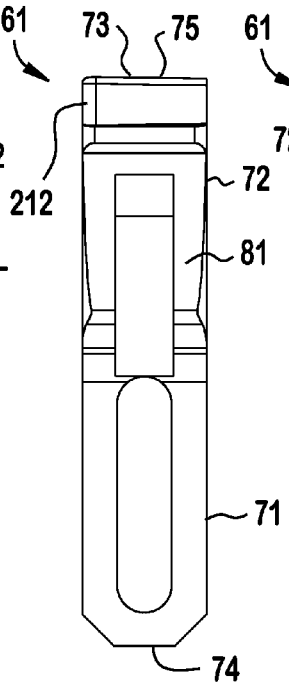
Figure 41:
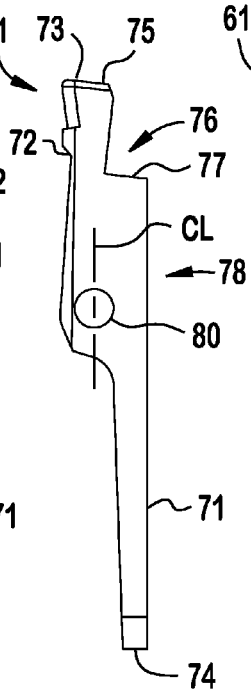
Figure 42:
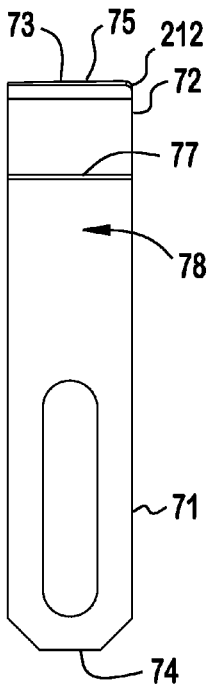
Figure 43:
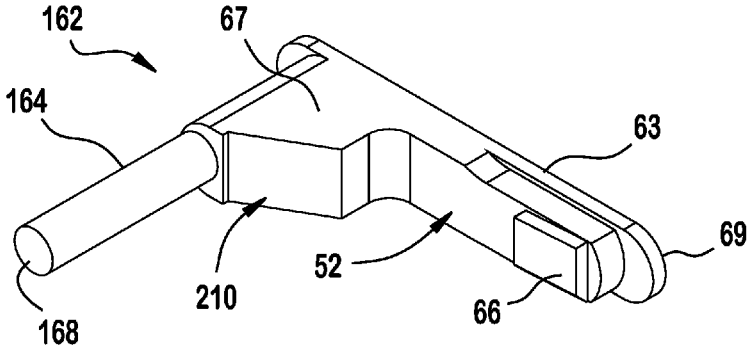
FIGS. 43-47 show various side, top, and perspective views of a second embodiment of a side catch lever of the second magazine latch mechanism, the side catch lever including a cam surface engaged by the cam protrusion of the rear catch lever.
Figure 44:
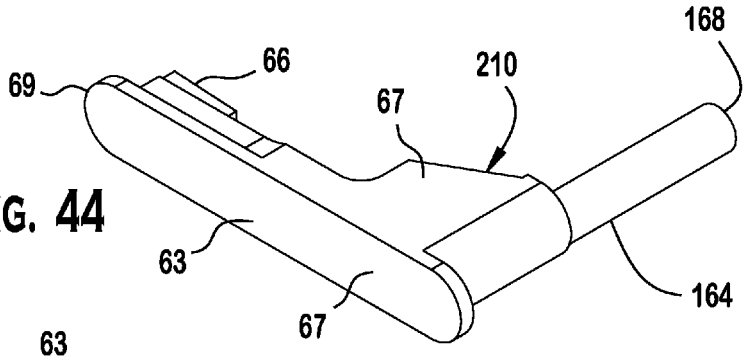
Figure 45:
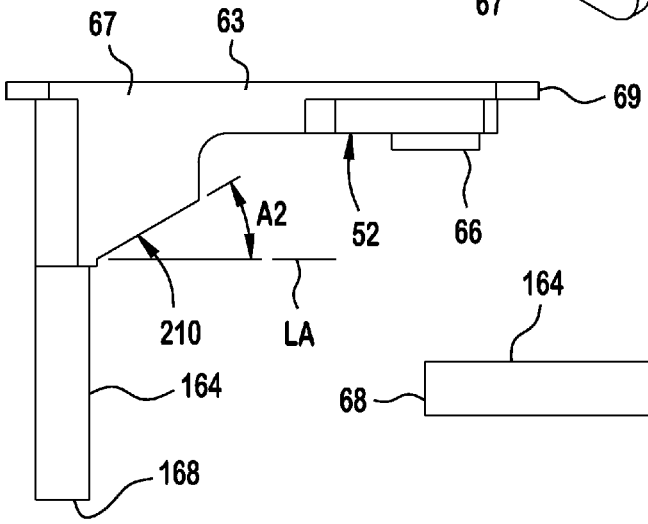
Figure 46:
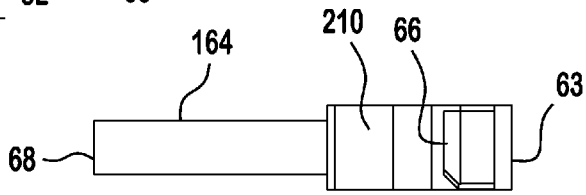
Figure 47:
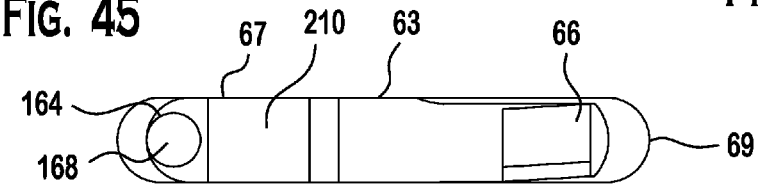

Operation of the side catch lever 162 alone to release a side catch style magazine 120 will now be briefly described. The cross-action side catch lever 162 started in the latched position engaged with and retaining a side catch style magazine 120 in magazine well 30, as shown in FIG. 32. To release the magazine 120, the user pushes laterally inward on actuating button 200 moving the button toward and farther into the frame 19 in a transverse direction. This slides the side catch lever 162 horizontally and laterally (perpendicular to the longitudinal axis LA), thereby moving the latching portion 63 of the side catch lever laterally and horizontally outward away from the sidewall 36 of the magazine well 30 and frame 19 in the same direction. It should be noted that this is strictly a linear motion of side catch lever 162 without any substantial angular or pivoting action of the lever. The latching protrusion 66 disengages the latch opening 121 in the side of magazine 120, thereby releasing and dropping the magazine.

According to one aspect of the invention, the side catch lever 162 may also be moved between the latched and unlatched positions by rear catch lever 61 as noted herein. Because the side catch lever 162 is not pivotably mounted to the lower receiver frame 19 as side catch lever 62, a camming action is provided instead to convert a forward toggle motion of the rear catch lever 61 (from the latched to unlatched position) into a lateral and transverse motion of the side catch lever 162 (from the latched to unlatched position). This allows the user to optionally continue to use the single rear catch lever 61 to retain and release all three types of rear, front, and side catch style magazines from the magazine well 30.

To produce the desired camming action, the side catch lever 162 includes a sloped or inclined cam surface 210 (see, e.g. FIGS. 43-47) which is engaged by a mating cam protrusion 212 on the rear catch lever 61 (see, e.g. FIGS. 36-42). Cam surface 210 may be a substantially flat and planar surface in top plan view (see FIG. 45). In one embodiment, the cam surface 210 is disposed proximate to elbow 67 on side catch lever 162 between the operating arm 164 and latching arm 63. The cam surface 210 is axially aligned with the rear catch lever 61 along the longitudinal axis LA of the rifle 20 for engagement by the rear catch lever. In one embodiment, the cam surface 210 may be angled or inclined at angle A2 between 0 and 90 degrees with respect to the longitudinal axis LA to impart a camming action and lateral movement to the side catch lever 162. In some preferably embodiments, angle A2 may be between about and including 20 and 60 degrees.

Cam protrusion 212 is formed on the upper latching portion 72 of rear catch lever 61 and projects in a rearward direction to engage cam surface 210 on the side catch lever 162. In one embodiment, cam protrusion 212 is disposed proximate to the top end 73 and adjacent upper ledge 75 of the rear catch lever 61. Cam protrusion 212 may form a corner of top end 73 and may be vertically elongated. In one embodiment, cam protrusion 212 may be radiused and rounded in profile to smoothly engage and slide along cam surface 210.

Figure 31:
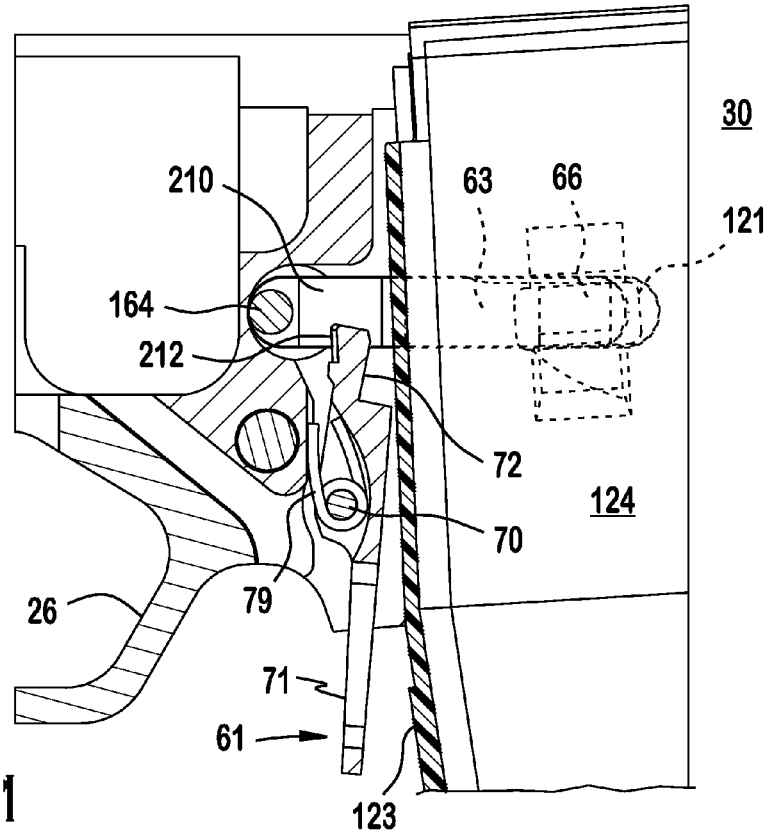
FIG. 31 is a partial cross-sectional side view of the second magazine latch mechanism showing a latched position with the magazine of FIG. 5.

FIGS. 31-34 show the operation of rear catch lever 61 to move side catch lever 162 between the latched and unlatch positions. In FIGS. 31-32, the rear catch lever 61 is not actuated and the side catch lever 162 is shown engaged with a side catch style magazine 120 (shown separately in FIG. 5) which is retained in the magazine well 30. The rear catch lever 61 and side catch lever 162 accordingly are in their respective latched positions.

To operate the cross-action side catch lever 162 using the rear catch lever 61, the user depresses the lower operating portion 71 of the rear catch lever forward moving the rear catch lever towards its unlatched position in the same manner already described herein. The opposite upper operating portion 72 of the lever progressively moves rearward engaged with the cam surface 210 of side catch lever 162 and compressing spring 150. The cam protrusion 212 pushes rearward against the cam surface 210 and slides along the surface towards the lateral button side of the side catch lever operating arm 164 (see, e.g. FIGS. 33-34). The inclined cam surface 210 imparts a horizontal transverse movement of the side catch lever 162 laterally to move the side catch lever from the latched to unlatched position shown in FIGS. 33-34, thereby withdrawing the latching protrusion 66 from latch opening 121 in magazine 120 and releasing the magazine from the magazine well 30.

After the magazine 120 is removed from the magazine well 30, the user may release the rear catch lever 61. The rear catch lever returns to its latched position under the biasing force of spring 79. This in turn allows the side catch lever 162 to return to its latched position under the biasing force of spring 150 which horizontally and transversely moves the side catch lever laterally in the opposite direction to its initial actuation. The rear catch lever 61 and side catch lever 162 are now back in the positions shown in FIGS. 31 and 32.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A universal magazine latching mechanism for a firearm, the mechanism comprising:

a frame defining a magazine well configured to releasably receive a magazine;

a rear catch lever pivotably mounted proximate to a rear wall of the magazine well about a first pivot axis, the rear catch lever configured and positioned with respect to the magazine well to retain and release a first magazine inserted in the magazine well having a rear catch;

the rear catch lever being movable between a latched position in which the rear catch lever engages the first magazine when inserted in the magazine well and an unlatched position in which the rear catch lever disengages the first magazine;

a side catch lever pivotably mounted to the frame about a second pivot axis, the side catch lever configured and positioned with respect to the magazine well to retain and release a second magazine inserted in the magazine well having a side catch;

the side catch lever being movable between a latched position in which the side catch lever engages the second magazine when inserted in the magazine well and an unlatched position in which the side catch lever disengages the second magazine;

wherein when the rear catch lever is moved from the latched position to the unlatched position, the rear catch lever engages and moves the side catch lever from the latched position to the unlatched position.

2. The magazine latch mechanism of claim 1, wherein the side catch lever is L-shaped and includes a transversely extending operating arm and a conjoined axially extending latching arm configured to engage the magazine inserted in the magazine well having the side catch.

3. The magazine latch mechanism of claim 2, wherein the pivot axis of the rear catch lever is disposed below the operating arm of the side catch lever.

4. The magazine latch mechanism of claim 2, wherein the pivot axis of side catch lever is formed at a terminal free end of the operating arm.

5. The magazine latch mechanism of claim 4, further comprising an inwardly projecting latching protrusion disposed proximate to a terminal free end of the latching arm, the protrusion being configured and operable to engage a side latching opening of the second magazine when inserted in the magazine well.

6. The magazine latch mechanism of claim 1, wherein the rear catch lever is configured so that vertically pivoting the rear catch lever about its pivot axis in turn horizontally pivots the side catch lever about its pivot axis.

7. The magazine latch mechanism of claim 1, wherein the rear catch lever includes an operating portion extending below the side catch lever and a latching portion disposed at least partially between the side catch lever and the magazine well, wherein a user pushing the operating portion forward pivotably moves the latching portion rearward which in turn pivots the side catch lever about its pivot axis between the latched and unlatched positions.

8. The magazine latch mechanism of claim 7, further comprising a first spring operably biasing the latching portion of the rear catch lever towards the magazine well into its latched position and a second spring operably biasing a lateral latching arm of the side catch lever towards the magazine well into its latched position.

9. The magazine latch mechanism of claim 1, wherein the rear catch lever includes a latching portion having a stepped structure defining a lower ledge configured to engage a magazine having the rear catch at a first elevation and an upper ledge configured to engage a magazine having the rear catch at a second elevation different than the first elevation.

10. The magazine latch mechanism of claim 9, wherein the stepped structure is defined on an inner forward facing surface of the latching portion adjacent to the magazine well.

11. The magazine latch mechanism of claim 10, further comprising a recessed pocket formed in an inner forward facing surface of the side catch lever which is configured to receive a top end of the latching portion of the rear catch lever for actuating the side catch lever with the rear catch lever.

12. The magazine latch mechanism of claim 1, wherein the rear catch lever includes a rear facing bearing surface that contacts the side catcher lever at a part farthest from the second pivot axis.

13. A universal magazine latching mechanism for a firearm, the mechanism comprising:

a frame defining a longitudinal axis and a magazine well configured to releasably receive a magazine;

an L-shaped side catch lever pivotably mounted to the frame about a first pivot axis, the side catch lever including an operation arm and a latching arm, the side catch lever configured and positioned with respect to the magazine well to retain and release a first magazine inserted in the magazine well;

a vertically elongated rear catch lever pivotably mounted proximate to a rear wall of the magazine well about a second pivot axis disposed below the side catch lever, the rear catch lever configured and positioned with respect to the magazine well to retain and release a second magazine inserted in the magazine well;

the side catch lever being movable between a latched position engaged with and retaining the first magazine when inserted in the magazine well, and an unlatched position disengaged from and releasing the first magazine from the magazine well; and the rear catch lever being movable between a latched position engaged with and retaining the second magazine when inserted in the magazine well, and an unlatched position disengaged from and releasing the second magazine from the magazine well;

wherein when the rear catch lever is moved from the latched position to the unlatched position, the rear catch lever engages and moves the side catch lever from the latched position to the unlatched position.

14. The magazine latch mechanism of claim 13, wherein the first pivot axis of the side catch lever is disposed at a terminal free end of the operating arm.

15. The magazine latch mechanism of claim 13, further comprising an inwardly projecting latching protrusion disposed proximate to a terminal free end of the latching arm, the protrusion being configured and operable to engage a latching opening of the first catch magazine when inserted in the magazine well.

16. The magazine latch mechanism of claim 13, further comprising a recessed pocket formed in an inner forward facing surface of the side catch lever which is configured to receive a top end of the rear catch lever for actuating the side catch lever using the rear catch lever.

17. The magazine latch mechanism of claim 13, wherein the rear catch lever includes an upper latching portion disposed above the second pivot axis and a conjoined lower operating portion disposed below the second pivot axis, the latching portion being positioned to engage and rearwardly displace the operating arm of the side catch lever when the rear catch lever is moved from the latched position to the unlatched position.

18. The magazine latch mechanism of claim 17, wherein the operating portion has a longer length than the latching portion to provide increased leverage for actuating the side catch lever.

19. The magazine latch mechanism of claim 17, wherein the latching portion has a stepped structure defining a lower ledge configured to engage a rear catch at a first elevation on the second magazine when inserted in the magazine well and an upper ledge configured to engage a rear catch at a second elevation of a third magazine when inserted in the magazine well, the first and second elevations being different.

20. The magazine latch mechanism of claim 19, wherein the stepped structure is defined on an inner forward facing surface of the latching portion disposed adjacent to the magazine well.

21. The magazine latch mechanism of claim 13, wherein the first pivot axis and the latching arm of the side catch lever are disposed on opposite sides of the longitudinal axis of the housing.

22. The magazine latch mechanism of claim 13, further comprising a first spring operably biasing the rear catch lever into the latched position and a second spring operably biasing the side catch lever into the latched position.

23. The magazine latch mechanism of claim 22, wherein the first spring is axially aligned with the longitudinal axis of the housing.

24. The magazine latch mechanism of claim 13, wherein the side catch lever is mounted proximate to a rear corner of the magazine well.

25. The magazine latch mechanism of claim 13 wherein the rear catch lever includes a rear facing bearing surface that contacts the side catcher lever at a part farthest from the first pivot axis.

* * * * *